US007413034B2

(12) United States Patent
Kirkhope et al.

(10) Patent No.: US 7,413,034 B2
(45) Date of Patent: Aug. 19, 2008

(54) STEERING TOOL

(75) Inventors: Kennedy Kirkhope, Sherwood Park (CA); Paul Rieder, Sherwood Park (CA); Lisa Yung, Edmonton (CA); Richard T. Hay, Spring, TX (US); Gary M. Crase, Yucca Valley (CA)

(73) Assignee: Halliburton Energy Services, Inc., Houston, TX (US)

( * ) Notice: Subject to any disclaimer, the term of this patent is extended or adjusted under 35 U.S.C. 154(b) by 145 days.

(21) Appl. No.: 11/399,349

(22) Filed: Apr. 7, 2006

(65) Prior Publication Data

US 2007/0235227 A1 Oct. 11, 2007

(51) Int. Cl.
*E21B 7/08* (2006.01)

(52) U.S. Cl. ..... 175/76; 175/73; 175/320

(58) Field of Classification Search ..... 175/61, 175/62, 73, 76, 320, 325.1
See application file for complete search history.

(56) References Cited

U.S. PATENT DOCUMENTS

| | | | | |
|---|---|---|---|---|
| 2,075,064 | A | 3/1937 | Schumacher et al. | |
| 2,153,680 | A | 4/1939 | Schmacher et al. | |
| 3,141,512 | A | 7/1964 | Gaskell et al. | |
| 3,243,001 | A | 3/1966 | Vincent | |
| 3,595,326 | A | 7/1971 | Claycomb | |
| 3,637,032 | A | 1/1972 | Jeter | |
| RE29,526 | E | 1/1978 | Jeter | |
| 4,394,881 | A * | 7/1983 | Shirley | 175/76 |
| 4,407,374 | A | 10/1983 | Wallussek et al. | |
| 5,168,941 | A | 12/1992 | Krueger et al. | |
| 5,265,682 | A | 11/1993 | Russell et al. | |
| 5,314,030 | A | 5/1994 | Peterson et al. | |
| 5,520,255 | A | 5/1996 | Barr et al. | |
| 5,553,678 | A | 9/1996 | Barr et al. | |
| 5,553,679 | A | 9/1996 | Thorp | |
| 5,582,259 | A | 12/1996 | Barr | |
| 5,603,386 | A | 2/1997 | Webster | |
| 5,673,763 | A | 10/1997 | Thorp | |
| 5,685,379 | A | 11/1997 | Barr et al. | |
| 5,695,015 | A | 12/1997 | Barr et al. | |
| 5,706,905 | A | 1/1998 | Barr | |

(Continued)

FOREIGN PATENT DOCUMENTS

| | | |
|---|---|---|
| GB | 9113713.3 | 6/1991 |

(Continued)

OTHER PUBLICATIONS

Schaaf, Stuart and Pafitis, Demos, "Field Application of a Fully Rotating Point-the-bit Rotary Steerable System," SPE/IADC Paper No. 67716, 2001.

(Continued)

*Primary Examiner*—Kenneth Thompson
(74) *Attorney, Agent, or Firm*—Terrance N. Kuharchuk; William Shull; William R. Peoples

(57) ABSTRACT

A steering tool for use in drilling a borehole, including a tubular housing, a tool actuating device movably supported within the housing, a plurality of hydraulically actuated steering devices circumferentially spaced about the housing, and a hydraulic control system interposed between the tool actuating device and the steering devices for converting an actuating movement of the tool actuating device to independent actuation of the steering devices.

61 Claims, 29 Drawing Sheets

U.S. PATENT DOCUMENTS

| | | | |
|---|---|---|---|
| 5,778,992 | A | 7/1998 | Fuller |
| 5,803,185 | A | 9/1998 | Barr et al. |
| 5,842,149 | A | 11/1998 | Harrell et al. |
| 5,957,221 | A | 9/1999 | Hay et al. |
| 6,021,377 | A | 2/2000 | Dubinsky et al. |
| 6,089,332 | A | 7/2000 | Barr et al. |
| 6,148,933 | A | 11/2000 | Hay et al. |
| 6,173,793 | B1 | 1/2001 | Thompson et al. |
| 6,179,066 | B1 | 1/2001 | Nasr et al. |
| 6,206,108 | B1 | 3/2001 | MacDonald et al. |
| 6,209,664 | B1 | 4/2001 | Amaudric du Chaffaut |
| 6,247,542 | B1 | 6/2001 | Kruspe et al. |
| 6,290,003 | B1 | 9/2001 | Russell |
| 6,419,033 | B1 | 7/2002 | Hahn et al. |
| 6,427,783 | B2 | 8/2002 | Krueger et al. |
| 6,439,325 | B1 | 8/2002 | Peters et al. |
| 6,446,736 | B1 | 9/2002 | Kruspe et al. |
| 6,513,606 | B1 | 2/2003 | Krueger |
| 6,516,898 | B1 | 2/2003 | Krueger |
| 6,540,032 | B1 | 4/2003 | Krueger |
| 6,550,548 | B2 | 4/2003 | Taylor |
| 6,564,883 | B2 | 5/2003 | Fredericks et al. |
| 6,595,303 | B2 | 7/2003 | Noe et al. |
| 6,609,579 | B2 | 8/2003 | Krueger et al. |
| 6,626,254 | B1 | 9/2003 | Krueger et al. |
| 6,637,524 | B2 | 10/2003 | Kruspe et al. |
| 6,727,696 | B2 | 4/2004 | Kruspe et al. |
| 6,739,409 | B2 | 5/2004 | Kruspe et al. |
| 6,761,232 | B2 | 7/2004 | Moody et al. |
| 6,840,336 | B2 | 1/2005 | Schaaf et al. |
| 6,913,095 | B2 | 7/2005 | Krueger |
| 2001/0042643 | A1 | 11/2001 | Krueger et al. |
| 2002/0011358 | A1 | 1/2002 | Wassell |
| 2002/0088648 | A1 | 7/2002 | Krueger et al. |
| 2002/0108784 | A1 | 8/2002 | Kruspe et al. |
| 2002/0153136 | A1 | 10/2002 | Kruspe et al. |
| 2002/0153888 | A1 | 10/2002 | Kruspe et al. |
| 2002/0175003 | A1 | 11/2002 | Pisoni et al. |
| 2002/0179336 | A1 | 12/2002 | Schaaf et al. |
| 2003/0056991 | A1 | 3/2003 | Hahn et al. |
| 2003/0146022 | A1 | 8/2003 | Krueger |
| 2003/0213620 | A1 | 11/2003 | Krueger |
| 2004/0016571 | A1 | 1/2004 | Krueger |
| 2004/0020691 | A1 | 2/2004 | Krueger |
| 2004/0026128 | A1 | 2/2004 | Krueger et al. |
| 2004/0035199 | A1 | 2/2004 | Meister et al. |
| 2004/0089475 | A1 | 5/2004 | Kruspe et al. |
| 2004/0089477 | A1 | 5/2004 | Moody et al. |
| 2004/0104051 | A1 | 6/2004 | Moriarity et al. |
| 2004/0196038 | A1 | 10/2004 | Kruspe et al. |
| 2004/0216921 | A1 | 11/2004 | Kruegar |
| 2004/0262041 | A1 | 12/2004 | Krueger et al. |
| 2005/0056463 | A1 | 3/2005 | Aronstam et al. |
| 2005/0061549 | A1 | 3/2005 | Evans et al. |
| 2005/0109542 | A1 | 5/2005 | Downton |
| 2005/0150692 | A1 | 7/2005 | Ballantyne et al. |
| 2005/0205302 | A1 | 9/2005 | Meister et al. |
| 2006/0021797 | A1 | 2/2006 | Krueger |

FOREIGN PATENT DOCUMENTS

| | | |
|---|---|---|
| GB | 2257182 | 6/1992 |

OTHER PUBLICATIONS

KW Downhole Tools, product brochure entitled "Deviation Eliminator," 4 pp., dated Jan. 20, 2004.
Product brochure of Baker Hughes entitled "The VertiTrak System," dated May 6, 2004 downloaded from www.bakerhughes.com website, 8 pp.
Schlumberger product brochure entitled "PowerDrive Xtra Series," 7 pp., undated.
Schlumberger product brochure entitled "PowerV," 5 pp., undated.

* cited by examiner

STEERING TOOL

TECHNICAL FIELD

A steering tool for use in drilling a borehole.

BACKGROUND OF THE INVENTION

In vertical drilling, a typical objective is to drill a consistently vertical borehole in a manner which minimizes the number and magnitude of unintended deviations of the borehole from vertical. In directional drilling, a typical objective is to drill a borehole along a predetermined path or paths to reach a subsurface target in a manner which minimizes the number and magnitude of unintended deviations and other unintended directional changes of the borehole.

In either case it is desirable to have the ability to control the drilling direction while drilling, since the existence of unintended directional changes complicates both drilling and completion and can increase the amount of time required to drill and complete the borehole.

Unintended directional changes in a borehole may be due to such causes as the characteristics of the formation being drilled, the characteristics of the drilling string, or to phenomena such as bit walk and reactive torque. The resulting borehole may exhibit crookedness or spiralling, may include doglegs and/or keyseats and may cause increased drag and torque on the drilling string, drilling string failures and production problems. The borehole may also miss an intended subsurface target.

Various options are available for providing steering capability to a drilling tool during drilling in an effort to ensure straightness and/or a desired direction of the borehole.

In directional drilling applications, a first option is to attach a bent-housing or a bent-sub downhole drilling motor to the end of the drilling string as a steering tool. When steering is required (such as, for example, to correct the effects of an unintended directional change) the drilling string can be restrained against rotation and the drilling motor can be pointed in a desired direction and operated for both drilling and steering in a "sliding drilling" mode. When steering is not required, the drilling string and the drilling motor can be rotated together in a "rotary drilling" mode. One advantage to this first option is its relative simplicity. One disadvantage to this first option is that steering is only possible in the sliding drilling mode. A second disadvantage to this first option is that the straightness of the borehole in rotary drilling mode may be compromised by the presence of the bent drilling motor.

A second option for steering in directional drilling applications is the use of a "rotary steerable" drilling system as a steering tool. In a rotary steerable drilling system, the drilling string may be rotated while the drilling tool is being steered either by being pointed or by being pushed in a desired direction either directly or indirectly by a steering device or steering devices. A rotary steerable drilling system may include a component which is non-rotating relative to the drilling string in order to provide a reference point for the desired direction and a mounting location for the steering device or devices. Alternatively, a rotary steerable drilling system may be "fully rotating".

One advantage to rotary steerable drilling systems is that they can provide relatively high steering accuracy. One disadvantage to rotary steerable drilling systems is that they tend to be relatively expensive and relatively complex apparatus, due in part to the necessity of determining orientations and directions in three dimensions for directional drilling applications.

U.S. Pat. No. 5,168,941 (Krueger et al) describes a drilling system which includes an array of extendable and retractable force transmitting members and pressure members which are actuated in response to positional data from sensors. The force transmitting members and pressure members are hydraulically actuated by electrically operated control valves using drilling fluid as the hydraulic fluid. The actuating pressure is generated by the creation of high pressure and low pressure drilling fluid regimes through the use of throttles either within the tool or in the borehole.

U.S. Pat. No. 5,603,386 (Webster) describes a drilling system which includes an array of extendable and retractable stabilizer blades. The system may be used for vertical well control. When used in vertical well control applications the stabilizer blades are hydraulically actuated in response to movement of ball bearing sensors which form a link in a "hydraulic solenoid" when the tool deviates from vertical. A system of pilot valves is actuated by the hydraulic solenoid in order to extend or retract the stabilizer blades. The actuating pressure is generated using a pump.

For vertical drilling applications, several options for steering tools are disclosed in the prior art for providing steering capability to a drilling tool during vertical drilling of a borehole.

U.S. Pat. No. 2,075,064 (Schumacher et al) describes a steering tool for use in rotary drilling which includes a free swinging pendulum mounted in a barrel, a closure plate positioned at the lower end of the pendulum, and a plurality of discharge ports associated with the closure plate. In operation, deviation of the drilling string from vertical results in blocking of the discharge port adjacent to the low side of the borehole, with the result that drilling fluid flowing through the barrel is preferentially directed against the high side of the borehole to exert a force to direct the drilling string back to a vertical orientation.

U.S. Pat. No. 2,153,680 (Schumacher et al) describes a steering tool for use in rotary drilling in which a plurality of discharge passages are associated with sealing rings located on an exterior surface of a pendulum mounted in a barrel. In operation, deviation of the drilling string from vertical results in the sealing rings sealing the discharge passages adjacent to the low side of the borehole, with the result that drilling fluid passing through the barrel is directed against the high side of the borehole to exert a force to direct the drilling string back to a vertical orientation.

U.S. Pat. No. 3,141,512 (Gaskell et al) describes a steering tool for use in sliding drilling in which a pendulum in a casing is associated with a plurality of potentiometers. In operation, deviation of the drilling string from vertical causes control signals to be generated by the potentiometers, which in turn actuates an electro-hydraulic control valve, which results in energization of one or more pistons located inside the casing and pivoting of a lower casing section relative to an upper casing section to bring the lower casing section in line with the pendulum. The pistons are hydraulically actuated using oil as the hydraulic fluid, which oil is pressurized by a pump.

U.S. Pat. No. 3,243,001 (Vincent) describes a steering tool for use in rotary drilling which includes a pendulum in a housing with a ring at its lower end which functions to selectively expose or block a plurality of ports which are located adjacent to the lower end of the pendulum during the passing of drilling fluid through the housing. The ports communicate with a plurality of conduits and pistons and each conduit is provided with an orifice for providing a pressure drop in the conduit. In operation, deviation of the drilling string from vertical causes the ring to block the port or ports adjacent to the high side of the borehole and expose the port or ports adjacent to the low side of the borehole. Exposure of the port or ports at the low side of the borehole results in actuation by drilling fluid of the piston associated with the port, which in turn causes the piston to exert a force on the inside of he housing to pivot the drilling string relative to the housing in a direction away from the low side of the borehole.

U.S. Pat. No. 3,637,032 (Jeter) and related U.S. Pat. No. Re. 29,526 (Jeter) describe a steering tool for use in rotary drilling which includes a pendulum inclinometer and a compass as direction sensing means which are mounted in a housing and which together rotate relative to the drilling string at the speed of the drilling string and in the opposite direction in order to hold the direction sensing means substantially non-rotative relative to the earth. In operation, deviation of the drilling string either azimuthally or vertically results in actuation of one or more mechanical valves, resulting in selective inflation of bladders by drilling fluid and extension of ribs to impose a lateral force on the drill bit to urge the drilling string back on course.

U.S. Pat. No. 5,314,030 (Peterson et al) describes a steering tool for use in sliding drilling which includes an oscillating pendulum which is mounted on a rotatable drilling shaft. The pendulum is constrained so that it can oscillate only in a single plane. In operation, deviation of the drilling string from vertical results in similar deviation of the oscillating pendulum. The amplitude and phase relationship of the oscillations of the pendulum relative to the angular position of the drilling shaft are sensed with a transducer to produce control signals. The control signals are used to regulate fluid jets from the drill bit, providing preferential flushing to guide the drill bit back to a vertical course.

The AutoTrak™ drilling system, developed by Baker Hughes INTEQ, is an automated steering system for use in sliding drilling to drill vertical wells. The AutoTrak™ system is therefore intended to be used in conjunction with a drilling motor. The AutoTrak™ system includes three extendable and retractable stabilizer pads, inclinometers, microprocessors and internal hydraulic pumps. In operation, deviation of the drilling string from a desired orientation is sensed by the inclinometers and results in activation of the hydraulic pumps. Signals from the inclinometers are provided to the microprocessors which calculate the force required to overcome the deviation. The hydraulic pumps then deliver an extending force to one or more of the stabilizer pads in order to direct the drilling string back to the desired orientation. The VertiTrak™ drilling system, also developed by Baker Hughes INTEQ, is a version of the AutoTrak™ system which has been adapted for use in vertical drilling applications.

The PowerDrive™ drilling system, developed by Schlumberger, is an automated steering system for use in rotary drilling to drill vertical wells. The PowerDrive™ system is a fully rotating rotary steerable system. The PowerDrive™ system includes a bias unit with extendable and retractable pads. The bias unit rotates with the drill string. The extension and retraction of the pads is synchronized with the rotation of the drill string so that the pads are extended and retracted at a consistent rotational orientation. The extension and retraction of the pads is controlled by a control unit which contains self-powered electronics and sensors. The control unit is a "roll-stabilized platform" which maintains a constant orientation by rotating relative to the drill string. The PowerV™ drilling system, also developed by Schlumberger, is a version of the PowerDrive™ system which has been adapted for use in vertical drilling applications.

There remains a need for a steering tool which is relatively easy to construct and maintain and which is relatively simple to operate. There remains a need for a steering tool which does not require electrical sensors or electrically operated valves in order to perform the steering function. There remains a need for a steering tool which can be adapted for use in either rotary drilling or sliding drilling.

SUMMARY OF THE INVENTION

The present invention is a steering tool for use in drilling a borehole. The steering tool is a hydromechanical tool which does not require electrical sensors or electrically operated valves.

The steering tool may be used for drilling vertical boreholes or non-vertical boreholes. In one preferred embodiment the steering tool is configured for use in drilling vertical boreholes.

The steering tool is intended to be incorporated into a drill string. The steering tool may be incorporated into a drill string in several different configurations, depending upon the drilling application.

In a first configuration the steering tool is adapted to be configured as a component of a drilling motor in order to provide steering capability to the drilling motor. In a second configuration the steering tool is adapted as a component of a rotary steerable drilling system of the type in which a steering mechanism is rotatably connected with a drill string. In a third configuration the steering tool is adapted as a component of a fully rotating rotary steerable drilling system of the type in which a steering mechanism is connected with a drill string so that the steering mechanism rotates with the drill string. In preferred embodiments, the steering tool is adapted to be configured as a component of a drilling motor.

In all configurations of the steering tool, the steering tool is comprised of a tubular housing, a tool actuating device, a plurality of hydraulically actuated steering devices, and a hydraulic control system interposed between the tool actuating device and the steering devices.

In a more specific aspect, the invention is a steering tool for use in drilling a borehole, comprising:

(a) a tubular housing, the housing having an interior, an exterior, and defining a housing bore;

(b) a tool actuating device movably supported within the interior of the housing, the tool actuating device being capable of an actuating movement relative to the housing;

(c) a plurality of hydraulically actuated steering devices circumferentially spaced about the exterior of the housing, the steering devices being independently actuatable between a retracted position and an extended position as a result of the actuating movement of the tool actuating device; and (d) a hydraulic control system contained within the interior of the housing and operably interposed between the tool actuating device and the steering devices, for converting the actuating movement of the tool actuating device to independent actuation of the steering devices between the retracted position and the extended position.

The steering tool may use any suitable fluid as a hydraulic fluid in the hydraulic control system. For example, the steering tool may use drilling fluid as the hydraulic fluid.

Preferably, however, the steering tool is further comprised of a hydraulic fluid other than drilling fluid for use in the hydraulic control system and preferably the hydraulic fluid is isolated from other fluids so that the hydraulic control system is a "closed system".

The hydraulic fluid may be comprised of any suitable natural or synthetic fluid which is known in the art as a "hydraulic fluid" and which is capable of withstanding the environment to which the steering tool may be subjected. The hydraulic fluid may include additives such as corrosion inhibitors etc.

In preferred embodiments, the hydraulic fluid is comprised of a fluid which is known in the art as a "hydraulic oil". A suitable hydraulic oil may be derived from natural or synthesized hydrocarbons. For example, a hydraulic oil selected from the Mobil SCH 600 Series ™ of lubricants, which are formulated from synthesized, wax-free hydrocarbon base fluids, may be suitable for use as the hydraulic oil in the steering tool.

The hydraulic control system uses a relatively low pressure hydraulic fluid and a relatively high pressure hydraulic fluid in order to actuate the steering devices between the retracted position and the extended position. As a result, the hydraulic control system preferably comprises a source of the relatively low pressure hydraulic fluid and a source of the relatively high pressure hydraulic fluid. The sources may be independent or they may be associated with each other.

Preferably, the hydraulic control system is comprised of a pressurization device for pressurizing the hydraulic fluid to provide a supply of pressurized hydraulic fluid as the source of the relatively high pressure hydraulic fluid.

The pressurization device may be comprised of any suitable structure, device or apparatus which is capable of pressurizing the hydraulic fluid. For example, the pressurization device may be comprised of a device which uses an ambient pressure in the vicinity of the steering tool to pressurize the hydraulic fluid. Alternatively, the pressurization device may be comprised of a pump.

If the pressurization device is comprised of a pump, any type of pump may be used. The pump may be configured as a component of the steering tool or the pump may be located remote from the steering tool. Preferably the pump is configured as a component of the steering tool.

The pump may be powered by any suitable power source. For example, the pump may be electrically powered, fluid powered, or the pump may be powered by relative movement between components of the steering tool and/or the drill string.

Preferably the pump is located partially or wholly within the interior of the housing or is otherwise associated with the housing.

In some preferred embodiments or configurations, the steering tool may be further comprised of a shaft extending through the housing bore. The shaft may be comprised of or may be connected with a length of a drill string or with a motor drive shaft. The shaft may define a shaft bore for conducting a drilling fluid through the steering tool.

The shaft may be capable of a drilling movement relative to the housing. The drilling movement may be a rotary movement or a reciprocating movement.

In embodiments or configurations of the steering tool which are comprised of the shaft, the pump may be associated with both the housing and the shaft and the pump may be powered by the drilling movement of the shaft relative to the housing. Where the drilling movement of the shaft is a rotary movement, the pump may be comprised of a suitable rotary pump. Where the drilling movement of the shaft is a reciprocating movement, the pump may be comprised of a suitable reciprocating pump.

The pump may be associated with the housing and the shaft in any manner. For example, the pump may be comprised of an annulus pump which is associated with the housing and the shaft such that components of the pump are connected with the housing and the shaft and such that components of the pump are also located in a tool annulus formed between the housing and the shaft.

If the pump is a rotary pump, a suitable rotary pump may, for example, be comprised of a gear pump or a swash plate pump. In preferred embodiments, the pump is comprised of a swash plate pump which is associated with both the housing and the shaft.

Any suitable type of swash plate pump may be used in the steering tool. Preferably, however, the swash plate pump is comprised of a swash plate pump which has been particularly designed for use in the steering tool.

A typical swash plate pump is comprised of a swash plate and a cylinder. The swash plate has an angled profile. The cylinder contains an array of piston assemblies which are spaced circumferentially around the cylinder. Each of the piston assemblies is comprised of a piston and a reciprocable actuator surface which is associated with the piston. The swash plate and the cylinder rotate relative to each other in order to cause sequential reciprocation of the pistons as the actuator surfaces follow the angled profile of the swash plate. In the typical swash plate pump, the actuator surfaces and the swash plate rotate relative to each other.

The preferred swash plate pump for use in the steering tool is further comprised of a stationary plate which is both pivotably and rotatably connected with the swash plate, preferably with a bearing assembly interposed between the swash plate and the stationary plate.

The stationary plate is configured so that the swash plate rotates relative to the stationary plate and so that the actuator surfaces and the stationary plate do not rotate relative to each other. As a result, the actuator surfaces of the piston assemblies are required essentially only to reciprocate relative to the stationary plate, and are not required to follow the angled profile of the swash plate.

The stationary plate may be comprised of a plurality of engagement surfaces which are adapted to engage with the actuator surfaces of the piston assemblies. The engagement surfaces may be comprised of dimples or depressions which are defined by the stationary plate and which are complementary to the actuator surfaces so that the actuator surfaces are maintained in the dimples or depressions during rotation of the swash plate and reciprocation of the actuator surfaces relative to the stationary plate.

The hydraulic control system may be comprised of any structure, device or apparatus which is capable of selectively and independently providing communication of the steering devices with the pressurized hydraulic fluid. The hydraulic control system may therefore be comprised of a suitable valve apparatus for providing the required communication. The valve apparatus may be comprised of a single valve mechanism which operates in conjunction with all of the steering devices or may be comprised of a plurality of valve mechanisms which each operate in conjunction with one or more of the steering devices.

Preferably the hydraulic control system is comprised of a plurality of valve mechanisms, wherein each of the valve mechanisms is associated with the tool actuating device and with one of the steering devices, and wherein each of the valve mechanisms is capable of selectively providing communication of its associated steering device with the pressurized hydraulic fluid as a result of the actuating movement of the tool actuating device.

The valve mechanisms are mechanically operated as a result of the actuating movement of the tool actuating device so that no electrical power is required to operate the valve mechanisms. As a result, each of the valve mechanisms is comprised of a mechanical valve actuator for the valve mechanism so that one mechanical valve actuator is associated with each of the steering devices.

The mechanical valve actuators may be comprised of any mechanical structure, device or apparatus which is compatible with the tool actuating device and which is capable of enabling the valve mechanisms to selectively provide communication with the pressurized hydraulic fluid as a result of the actuating movement of the tool actuating device. As a first non-limiting example, the mechanical valve actuators may be comprised of buttons or latches which may be moved by the tool actuating device. As a second non-limiting example, the mechanical valve actuators may be comprised of levers which may be moved by the tool actuating device.

In all embodiments of the mechanical valve actuators, the mechanical valve actuators must be capable of being moved by the tool actuating device. More particularly, an actuating force is associated with the actuating movement of the tool actuating device, which actuating force must be sufficient to cause movement of the mechanical valve actuators.

Preferably the mechanical valve actuators are located in the interior of the housing. The mechanical valve actuators are circumferentially spaced about the housing and are located adjacent to the tool actuating device so that they may be moved by the actuating movement of the tool actuating device.

In preferred embodiments the mechanical valve actuators are comprised of actuating levers which are circumferentially spaced about the interior of the housing. The actuating levers may be any shape or size which is compatible with both the tool actuating device and the housing.

The actuating levers are comprised of a pivot point so that the actuating levers pivot about the pivot point in response to the actuating movement of the tool actuating device. Preferably the actuating levers are substantially balanced about the pivot point so that centrifugal force generated during rotation of the steering tool does not tend to cause the actuating levers to pivot.

The mechanical valve actuators are preferably configured to be capable of movement by the tool actuating device between a first actuator position and a second actuator position. Furthermore, in preferred embodiments the steering tool is configured so that each of the steering devices is actuated to the retracted position when its associated mechanical valve actuator is in the first actuator position and so that each of the steering devices is actuated to the extended position when its associated mechanical valve actuator is in the second actuator position.

The hydraulic control system may be further comprised of a reservoir for the hydraulic fluid. Preferably the reservoir has a reservoir pressure which is lower than a pressure of the pressurized hydraulic fluid. Preferably the hydraulic control system is configured so that the pressurization device draws the hydraulic fluid from the reservoir in order to provide the supply of the pressurized hydraulic fluid.

The steering tool may be configured so that each of the steering devices is in communication only with the reservoir when its associated mechanical valve actuator is in the first actuator position, and the steering tool may be configured so that each of the steering devices is in communication only with the pressurized hydraulic fluid when its associated mechanical valve actuator is in the second actuator position. This configuration provides a "single-acting" hydraulic system in which the steering devices are actively actuated in one direction and passively actuated in the other direction.

Alternatively, the steering tool may be configured so that each of the steering devices is in communication with both the reservoir and the pressurized hydraulic fluid when the mechanical valve actuator is both in the first actuator position and in the second actuator position. This configuration provides a "double-acting" hydraulic system in which the steering devices are actively actuated in both directions.

Each of the valve mechanisms may be further comprised of any suitable type of valve. If the steering tool is configured as a single-acting hydraulic system, a single valve or a combination of valves with three ports may be used to provide the necessary hydraulic routing between the pressurized hydraulic fluid, the reservoir and the steering device. If the steering tool is configured as a double-acting hydraulic system, then a single valve or a combination of valves with four ports may be used to provide the necessary hydraulic routing between the pressurized hydraulic fluid, the reservoir and the steering device.

In some preferred embodiments, the valve mechanism may be comprised of a single shuttle valve or a single spindle valve which reciprocates between seating against a pressurized hydraulic fluid port and a reservoir port in response to movement of the mechanical valve actuator, while always maintaining communication with the steering device via a steering device port. This configuration is particularly suited for use in providing a single-acting hydraulic system.

In one particular preferred embodiment, the valve mechanism may be comprised of a single spindle valve which reciprocates between positions in which different combinations of pairs of ports are in communication with each other in response to movement of the mechanical valve actuator. In this embodiment, when the mechanical valve actuator is in the first actuator position, a pressurized hydraulic fluid port may be in communication with a first steering device port while a reservoir port may be in communication with a second steering device port. Furthermore, in this embodiment, when the mechanical valve actuator is in the second actuator position, the pressurized hydraulic fluid port may be in communication with the second steering device port while the reservoir port may be in communication with the first steering device port.

The hydraulic control system may be further comprised of one or more pressure relief valves which are associated with the pressurization device and which provide selective communication with the reservoir in the event that the pressure of the pressurized hydraulic fluid exceeds a threshold pressure due to excessive resistance or blockage between the pressurization device and the steering devices. In preferred embodiments a first pressure relief valve is configured to provide communication with the reservoir at a first threshold pressure and a second pressure relief valve is configured to provide communication with the reservoir at a second threshold pressure.

The tool actuating device may be comprised of any structure, device or apparatus which is capable of enabling the valve mechanisms to selectively provide communication with the pressurized hydraulic fluid as a result of the actuating movement of the tool actuating device. Where the valve mechanisms are comprised of mechanical valve actuators, the tool actuating device is compatible with the valve actuators.

As a first non-limiting example, the tool actuating device may be comprised of a gyroscope which generates the actuating movement relative to the housing in response to a change in the orientation of the housing as the gyroscope exerts an inertial force to maintain its orientation. As a second non-limiting example, the tool actuating device may be comprised of a weight which generates the actuating movement relative to the housing by moving along a track in response to a change in the orientation of the housing. As a third non-limiting example, the tool actuating device may be comprised of a pendulum which is pivotably supported by the housing and which generates the actuating movement relative to the housing in response to a change in the orientation of the housing as the pendulum pivots to maintain a vertical orientation.

In all embodiments of the tool actuating device, movement of the housing away from a target orientation results in the actuating movement of the tool actuating device, which actuating movement is converted by the hydraulic control system to independent actuation of the steering devices in order to move the housing back toward the target orientation.

In some embodiments of the tool actuating device, the actuating movement may be caused by a gravitational force in response to a change in the orientation of the housing relative to gravity. In other embodiments of the tool actuating device, the actuating movement may be an inertial force in response to a change in the orientation of the housing relative to a target orientation. In still other embodiments of the tool actuating device, the actuating movement may be caused by a magnetic force in response to a change in the orientation of the housing relative to a magnetic field.

Regardless of the embodiment of the tool actuating device, the target orientation of the housing may be a vertical orientation or may be some other orientation. Where the tool actuating device provides the actuating movement in response to a gravitational force, the tool actuating device must be oriented in the steering tool relative to the target orientation such that a deviation from the target orientation may be sensed by the tool actuating device in order to provide the actuating movement.

In preferred embodiments, the "distance" between the first actuator position and the second actuator position of the mechanical valve actuators represents the amount of deviation of the housing which will trigger the actuation of the steering devices. For example, in preferred embodiments a deviation of the housing from the target orientation of about 0.183 degrees will result in movement of the mechanical valve actuators between the first actuator position to the second actuator position. The distance between the first actuator position and the second actuator position may therefore be selected to provide a threshold amount of deviation above which correction of the deviation will occur.

In preferred embodiments, the tool actuating device is comprised of a pendulum which is pivotably supported within the interior of the housing, so that the actuating movement of the pendulum is a pivoting movement relative to the housing in order to maintain a vertical orientation of the pendulum. The pivoting movement of the pendulum moves the mechanical valve actuators in order to operate the valve apparatus.

The pendulum is preferably comprised of a tubular member which is located in the interior of the housing such that the pendulum surrounds the housing bore.

The pendulum is comprised of a proximal end and a distal end. Preferably the proximal end of the pendulum is pivotably supported within the housing, and preferably the mechanical valve actuators are located adjacent to the distal end of the pendulum.

As mentioned, an actuating force is associated with the actuating movement of the tool actuating device, which actuating force must be sufficient to cause independent actuation of the steering devices, such as by movement of the mechanical valve actuators.

As a result, the pendulum is preferably configured so that the magnitude of the actuating force is optimized for the selected type of mechanical valve actuator. For most mechanical valve actuators, the center of gravity of the pendulum is preferably located closer to the distal end of the pendulum than to the proximal end of the pendulum. The center of gravity of the pendulum may be determined by the shape and/or construction of the pendulum. Alternatively or additionally, one or more weights may be added to the pendulum both to increase the weight of the pendulum and to position the center of gravity of the pendulum toward the distal end of the pendulum.

In preferred embodiments, the pendulum is comprised of at least one weighting ring for adding weight to the pendulum. Preferably the weighting rings are located closer to the distal end of the pendulum than to the proximal end of the pendulum. The weighting rings may be comprised of any suitable material, but in preferred embodiments the weighting rings are comprised of a relatively dense material such as carbide so that the weighting rings are comprised of carbide rings.

The pendulum may be pivotably supported within the housing in any manner. As a first non-limiting example, the pendulum may be pivotably supported within the housing by a ball and socket joint. As a second non-limiting example, the pendulum may be pivotably supported within the housing by a single hinge so that the pendulum may pivot in a single plane (thus limiting the steering capabilities of the steering tool). As a third non-limiting example, the pendulum may be pivotably supported within the housing by two hinges oriented in perpendicular planes, often referred to as a universal joint.

In preferred embodiments, the pendulum is supported within the housing by a universal joint.

Preferably the pivoting movement of the pendulum is damped. The pivoting movement of the pendulum may be damped in any manner. Preferably the pendulum is supported within the housing in a viscous medium so that the pivoting movement of the pendulum is subject to viscous damping. The properties of the viscous medium and the extent of the viscous damping may be controlled by selecting an appropriate fluid as the viscous medium.

The viscous medium may be comprised of any fluid which can provide a suitable amount of viscous damping and which is capable of withstanding the environment to which the steering tool may be subjected. For example, the viscous medium may be comprised of a suitable hydraulic fluid.

In preferred embodiments, the viscous medium is comprised of a fluid which is known in the art as a "hydraulic oil". A suitable hydraulic oil may be derived from natural or synthesized hydrocarbons. For example, a hydraulic oil selected from the Mobil SCH 600 Series™ of lubricants, which are formulated from synthesized, wax-free hydrocarbon base fluids, may be suitable for use as the viscous medium.

The viscous medium may also be comprised of a fluid which is similar to the hydraulic fluid which is used in the hydraulic control system, or may be comprised of a fluid which is not similar to the hydraulic fluid which is used in the hydraulic control system. Typically, the viscous medium will be comprised of a fluid which has a higher viscosity than the hydraulic fluid which is used in the hydraulic control system.

The steering tool preferably is further comprised of a pendulum chamber for containing the pendulum and the viscous medium. If the same fluid is used as the viscous medium and as the hydraulic fluid which is used in the hydraulic control system, the pendulum chamber may communicate with the hydraulic control system.

Preferably, however, the pendulum chamber is isolated from the hydraulic control system so that the viscous medium is isolated from the hydraulic fluid which is used in the hydraulic control system.

The pendulum is preferably supported within the interior of the housing so that the axis of pendulum is aligned with the target orientation of the housing. As a first example, where the target orientation of the housing is a vertical orientation the pendulum is preferably supported within the interior of the housing so that the axis of the pendulum is parallel with the axis of the housing when the housing is at a vertical orientation. As a second example, where the target orientation of the housing is not a vertical orientation, the pendulum is preferably supported within the interior of the housing so that the axis of the pendulum is not parallel with the axis of the housing when the housing is at a vertical orientation, but instead is aligned with the target orientation of the housing.

Alternatively or additionally, where the target orientation of the housing is not a vertical orientation, the mechanical valve actuators may be configured so that they are all at the first actuator position or are all at the second actuator position when the housing is oriented at the target orientation and so that they are moved to the other position when the orientation of the housing deviates from the target orientation.

The hydraulic control system is preferably further comprised of a hydraulic fluid pressure balancing mechanism for transmitting to the hydraulic fluid a first ambient pressure. The first ambient pressure is preferably a pressure at-a first pressure balancing position on the exterior of the housing.

Similarly, the steering tool is preferably further comprised of a viscous medium pressure balancing mechanism for transmitting to the viscous medium a second ambient pressure. The second ambient pressure is preferably a pressure at a second pressure balancing position on the exterior of the housing.

The hydraulic fluid pressure balancing mechanism and the viscous medium pressure balancing mechanism may each be comprised of any suitable structure, device or apparatus which is capable of transmitting the ambient pressures to the hydraulic fluid and the viscous medium respectively.

The first ambient pressure and the second ambient pressure may be the same pressure or they may be different pressures. The first pressure balancing position and the second pressure balancing position may be the same positions on the exterior of the housing or they may be different positions.

If the pendulum chamber communicates with the hydraulic control system, if the first ambient pressure is intended to be the same as the second ambient pressure, or if the first pressure balancing position is the same as the second pressure balancing position, a single pressure balancing mechanism may be used as both the hydraulic fluid pressure balancing mechanism and the viscous medium pressure balancing mechanism.

However, preferably the pendulum chamber does not communicate with the hydraulic control system, preferably the first ambient pressure is not the same as the second ambient pressure, and preferably the first pressure balancing position is not the same as the second pressure balancing position.

More particularly, the housing has an upper end and a lower end, and the steering devices are located between the upper end and the lower end of the housing.

In preferred embodiments, the first pressure balancing position is preferably between the steering devices and the lower end of the housing and the second pressure balancing position is preferably between the upper end of the housing and the steering devices. Furthermore, in preferred embodiments, the hydraulic control system is further comprised of an emergency relief valve which is connected between the hydraulic control system and the pendulum chamber such that the hydraulic control system communicates with the pendulum chamber when the emergency relief valve is in an open position, thereby releasing the hydraulic fluid from the hydraulic control system into the pendulum chamber. This configuration allows for hydraulic fluid from the hydraulic control system to be dumped into the pendulum chamber in the event that the steering devices effectively "pack-off" a borehole during use of the steering tool, since the pendulum chamber will in such circumstances be balanced to a lower pressure than the hydraulic control system.

The steering tool is configured to actuate the steering devices in order to maintain a target orientation of the housing of the steering tool. In this regard, the steering devices may be configured either to extend or to retract in order to maintain the target orientation.

For example, the steering devices may be configured to be actuated to the retracted position when the housing is at the target orientation. In this configuration, deviation of the housing from the target orientation will cause the tool actuating device to generate the actuating movement, which actuating movement will be converted by the hydraulic control system to actuate one or more of the steering devices to the extended position in order to push the housing back toward the target orientation.

Alternatively, the steering devices may be configured to be actuated to the extended position when the housing is at the target orientation. In this configuration, deviation of the housing from the target orientation will cause the tool actuating device to generate the actuating movement, which actuating movement will be converted by the hydraulic control system to actuate one or more of the steering devices to the retracted position in order to allow the housing to move back toward the target orientation.

The number of steering devices which are actuated to correct a deviation of the housing from the target orientation depends upon the direction of the deviation and upon the number of steering devices which are provided in the steering tool. A minimum of three steering devices is required to provide steering capability of the steering tool in all directions. The maximum number of steering devices to be provided in the steering tool is dependent upon the size and configuration of the steering tool. Preferably the steering tool is comprised of three or four steering devices. In preferred embodiments the steering tool is comprised of four steering devices which are circumferentially spaced from each other by ninety degrees.

In preferred embodiments, the steering devices are configured to be actuated to the retracted position when the housing is at the target orientation and to be actuated to the extended position only when necessary to correct a deviation of the housing from the target orientation. Furthermore, in preferred embodiments the steering tool is configured so that each of the mechanical valve actuators is at the first actuator position when the housing is at the target orientation and so that the mechanical valve actuators are selectively moved to the second actuator position by the tool actuating device in response to a deviation of the housing from the target orientation.

As a result, in the preferred embodiments where the tool actuating device is comprised of a pendulum or some other gravity dependent device, the steering devices and their associated mechanical valve actuators are preferably offset from each other by substantially 180 degrees, which means that the centerlines of the steering devices and the centerlines of their associated mechanical valve actuators are preferably offset from each other by substantially 180 degrees.

This configuration will allow the pendulum or other gravity dependent device to provide the actuating movement toward the "low side" of the steering tool and allow the steering device or devices on the "high side" of the steering tool to actuate to the extended position to push the housing away from the high side.

The valve apparatus may be further comprised of a biasing device for biasing the mechanical valve actuators toward the first actuator position. More particularly, each of the valve mechanisms may be further comprised of a valve mechanism biasing device for biasing its associated mechanical valve actuator toward the first actuator position. The valve mechanism biasing devices may be comprised of any suitable structure, device or apparatus. In preferred embodiments the valve mechanism biasing devices are comprised of springs.

The valve apparatus may be further comprised of a mechanical actuator dampening mechanism for dampening the movement of the mechanical valve actuators. More particularly, each of the valve mechanisms may be comprised of a mechanical actuator dampening mechanism for dampening the movement of its associated mechanical valve actuator. The mechanical actuator dampening mechanisms may be comprised of any structure, device or apparatus which is capable of providing the desired dampening.

Preferably each mechanical actuator dampening mechanism is comprised of a fluid metering device which is operably connected with the mechanical valve actuator. In preferred embodiments the fluid metering device is comprised of:

(a) a dampening cylinder;

(b) a metering piston reciprocably contained within the dampening cylinder so that the dampening cylinder is divided into a first chamber and a second chamber; and (c) a restricted flowpath between the first chamber and the second chamber for permitting a restricted flow of a fluid between the first chamber and the second chamber as the metering piston reciprocates relative to the dampening cylinder as a result of movement of the mechanical valve actuator.

The steering devices may be comprised of any structure, device or apparatus which is capable of being hydraulically actuated between the retracted position and the extended position. Preferably each of the steering devices is comprised of at least one steering piston which is actuatable between the retracted position and the extended position. More preferably, each of the steering devices is comprised of a plurality of steering pistons which are simultaneously actuatable between the retracted position and the extended position.

The number of steering pistons may be selected to provide a desired steering device force for pushing the housing, since the number of steering pistons will be directly proportional to the steering device force. In preferred embodiments each of the steering devices is comprised of four steering pistons.

The steering devices may be configured so that the steering pistons directly contact a borehole wall. Preferably, however, each of the steering devices is further comprised of a steering blade which is connected with the steering pistons and which extends and retracts with the steering pistons.

The steering blades may be comprised of any suitable device, structure or apparatus. Preferably the steering devices are configured so that the steering blades may be replaced without disassembling the steering tool.

In preferred embodiments, each of the steering blades is connected with each of its associated steering pistons by one or more bolts which are accessible from the exterior of the steering tool. Furthermore, in preferred embodiments each of the steering blades is retained in a steering blade cavity in the exterior of the housing by blade stop members which are located at both ends of the steering blade. Each of the blade stop members is connected with the housing by one or more bolts which are accessible from the exterior of the steering tool. This configuration enables the steering blades to be replaced without disassembling the steering tool.

The steering blades may be removed and replaced due to wear or for servicing. In addition, the steering blades may be removed and replaced with steering blades of a different size in order to accommodate drilling of different sizes of borehole using the steering tool.

The weight of the steering blades is preferably minimized. As a result, the steering blades may be formed as a honeycomb structure or some similar frame structure which includes void spaces. The steering blades may also be constructed at least in part of a suitable relatively lightweight material such as aluminum.

If the steering blades are constructed of a material such as aluminum, a steering blade cover may be provided over the aluminum structure in order to improve the wear resistance of the steering blade. The steering blade cover may by formed of a suitable material such as steel and may be treated, such as by hard-facing, to improve the wear resistance of the steering blade cover. Preferably the thickness of the steering blade cover is minimized in order to minimize further the total weight of the steering blade.

Each of the steering devices is preferably further comprised of a steering device biasing mechanism for biasing the steering device toward the position it is in when the housing is at the target orientation. For example, if the steering device is in the retracted position when the housing is at the target orientation, then the steering device is preferably biased toward the retracted position. Alternatively, if the steering device is in the extended position when the housing is at the target orientation, then the steering device is preferably biased toward the extended position.

As a result, in preferred embodiments each of the steering devices is further comprised of a steering device biasing mechanism for biasing the steering device toward the retracted position. The steering device biasing mechanism may be comprised of any structure, device or apparatus which is capable of providing the biasing function. The steering device biasing mechanism may be associated with the steering pistons and/or the steering blade. In the preferred embodiments the steering device biasing mechanism is comprised of a plurality of springs which are associated with each of the steering pistons.

The steering tool may be further comprised of a stabilizer for enhancing the operation of the steering tool. Preferably the stabilizer is associated with the housing. The stabilizer may be located at any suitable position relative to the steering devices. Preferably the stabilizer is located between the upper end of the housing and the steering devices.

The stabilizer may be comprised of a plurality of stabilizer blades circumferentially spaced about the exterior of the housing. The stabilizer blades may be removable, in which case the stabilizer blades may be connected with the steering tool in any suitable manner. Preferably the stabilizer blades are removable without disassembling the steering tool.

The stabilizer blades may be connected with the housing using blade block members, in a manner similar to how the steering blades are connected with the housing.

Preferably, however, each of the stabilizer blades is retained in a stabilizer blade cavity in the housing by a stabilizer retaining ring and the combination of an undercut formed in the stabilizer blade and an overcut formed in the stabilizer blade cavity. The stabilizer blade is inserted in the stabilizer blade cavity so that the undercut in the stabilizer blade engages the overcut in the stabilizer blade cavity, and then the stabilizer retaining ring is tightened to hold the stabilizer blade in the stabilizer blade cavity. The stabilizer blade may be removed from the steering tool by loosening the stabilizer retaining ring and then withdrawing the undercut in the stabilizer blade from the overcut in the stabilizer blade cavity.

In preferred embodiments, the hydraulic control system may be configured to minimize the extent to which the steering devices become actuated to the extended position unless required in order to correct a deviation of the housing from the target orientation, thus minimizing wear of the steering devices, minimizing drag on the drill string, and minimizing the likelihood of the steering tool becoming stuck in a borehole.

This result may be achieved by providing that the steering devices become actuated to the extended position more slowly than they become actuated to the retracted position. In some embodiments this may be made possible by providing that the flowrate of the pressurized hydraulic fluid to the steering devices as they become actuated to the extended position is less than the flowrate of the pressurized hydraulic fluid from the steering devices as they become actuated to the retracted position.

The flowrate of the pressurized hydraulic fluid to the steering devices may be limited by controlling the pumping rate of the pressurization device. In preferred embodiments, the pumping rate of the swash plate pump may be controlled by adjusting the angled profile of the swash plate or by adjusting the size and/or number of the piston assemblies. Limiting the flowrate of the pressurized hydraulic fluid to the steering devices is effective in minimizing inadvertent actuation of the steering devices to the extended position where the hydraulic control system is a single-acting hydraulic system.

The flowrate of the pressurized hydraulic fluid between the pressurization device and the steering devices may be controlled by restricting the flowpath between the pressurization device and the valve mechanisms by limiting its area or by providing a flow restrictor device in the flowpath. Restricting the flowrate of the pressurized hydraulic fluid between the pressurization device and the steering devices is effective in minimizing inadvertent actuation of the steering devices to the extended position where the hydraulic control system is a single-acting hydraulic system.

The flowrate of the pressurized hydraulic fluid to and from the steering devices may also be controlled with the assistance of the steering device biasing mechanisms, which in the preferred embodiments bias the steering devices toward the retracted position. The biasing effect of the steering device biasing mechanisms and/or of any external forces which may be exerted on the steering devices effectively opposes the actuation of the steering devices to the extended position and effectively assists the actuation of the steering devices to the retracted position. The biasing effect may therefore cause the steering devices to be actuated to the extended position more slowly than they are actuated to the retracted position.

In preferred embodiments where the steering tool is adapted to be connected with a drilling motor, the hydraulic control system may further be configured to minimize the extent to which the steering devices become actuated to the extended position when the drill string and thus the housing of the steering tool is being rotated during rotary drilling, even when the housing is not at the target orientation.

This result may be achieved by providing that during each rotation of the housing, the extent to which the steering devices become actuated to the extended position is less than the extent to which the steering devices become actuated to the retracted position. For example, this result may be achieved by providing that during each rotation of the housing, the amount of the hydraulic fluid which is delivered to the steering devices to extend the steering devices is less than the amount of the hydraulic fluid which is delivered from the steering devices to retract the steering devices.

This result may also be achieved by providing that the steering devices become actuated to the extended position more slowly than they become actuated to the retracted position. As discussed above, the steering device biasing mechanisms and/or any external forces which may be exerted on the steering devices may assist in achieving this result by effectively opposing the actuation of the steering devices to the extended position and by effectively assisting the actuation of the steering devices to the retracted position.

Inadvertent actuation of the steering devices to the extended position during rotation of the drill string may therefore be minimized using the same techniques as described above for generally minimizing inadvertent actuation of the steering devices to the extended position.

In addition, inadvertent actuation of the steering devices to the extended position during rotation of the drill string in the preferred embodiments may be minimized by ensuring that the mechanical valve actuators are in the second actuator position for less time during one rotation of the drill string than they are in the first actuator position during one rotation of the drill string. This may be achieved by providing that the mechanical valve actuators are moved to the first position for less than 180 degrees during one rotation of the drill string. This in turn may be achieved by providing that each of the mechanical valve actuators extends circumferentially around the housing less than 180 degrees.

As mentioned, the steering tool may be used in several different configurations.

In a first configuration the steering tool is adapted to be configured as a component of a drilling motor in order to provide steering capability to the drilling motor. In this configuration the drilling motor preferably has a motor housing and a motor drive shaft. The steering tool is preferably located below the power section of the drilling motor. The housing of the steering tool is connected with the motor housing either integrally or as a separate piece or component. The motor drive shaft extends through the housing bore. The portion of the motor drive shaft extending through the housing bore may be formed integrally with the motor drive shaft which extends from the power section, or may be a separate piece or component which is connected with the motor drive shaft as an extension thereof. A drill bit may be connected to the motor drive shaft adjacent to the lower end of the steering tool. In this first configuration, the motor drive shaft may be provided with a shaft bore so that drilling fluid may be passed through the steering tool.

In a second configuration the steering tool is adapted as a component of a rotary steerable drilling system of the type in which a steering mechanism is rotatably connected with a drill string. In this second configuration the drill string extends through the housing bore and the housing is connected with the drill string so that the drill string may rotate relative to the housing. The housing may be connected with the drill string using suitable bearings. In this second configuration drilling fluid may be passed through the drill string in order to circulate the drilling fluid through the steering tool.

The steering tool in this second configuration may be further comprised of a borehole engaging device associated with the housing for engaging a borehole in order to inhibit the steering tool from rotating in the borehole when the drill string is rotated. The borehole engaging device may be comprised of a plurality of borehole engaging members which are spaced circumferentially around the exterior of the housing. The borehole engaging members may be spring loaded so that they are capable of maintaining engagement with the borehole if the size of the borehole varies.

In a third configuration the steering tool is adapted as a component of a fully rotating rotary steerable drilling system of the type in which a steering mechanism is connected with a drill string so that the steering mechanism rotates with the drill string. In this third configuration, the tool actuating device, steering devices and the hydraulic control system are configured so that the steering devices are capable of actuating between the retracted position and the extended position in synchronization with the rotation of the drill string so that the steering devices are actuated substantially at the same rotational position during rotation of the drill string in order to move the housing back toward the target orientation. In this third configuration, drilling fluid may be passed through the housing bore in order to circulate drilling fluid through the steering tool.

In all configurations of the steering tool, the drill string may be comprised of any suitable drilling equipment and drilling tools for use in association with the steering tool.

BRIEF DESCRIPTION OF DRAWINGS

Embodiments of the invention will now be described with reference to the accompanying drawings, in which.

DETAILED DESCRIPTION

Figure 1A:
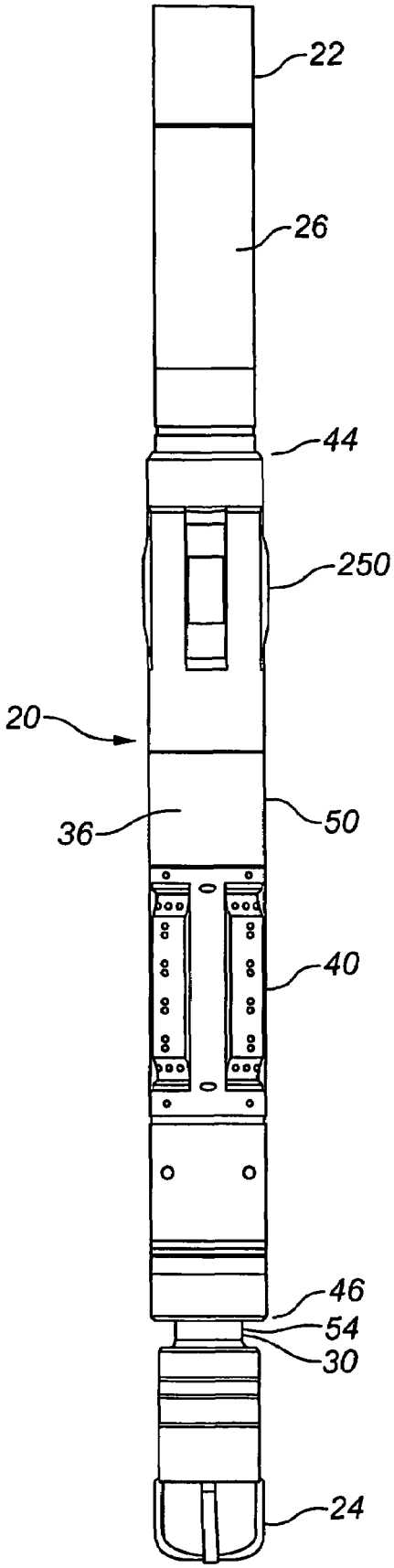
FIGS. 1(*a*)-1(*c*) are schematic drawings of a portion of a drill string depicting three different configurations of a steering tool according to the invention.
Figure 1B:
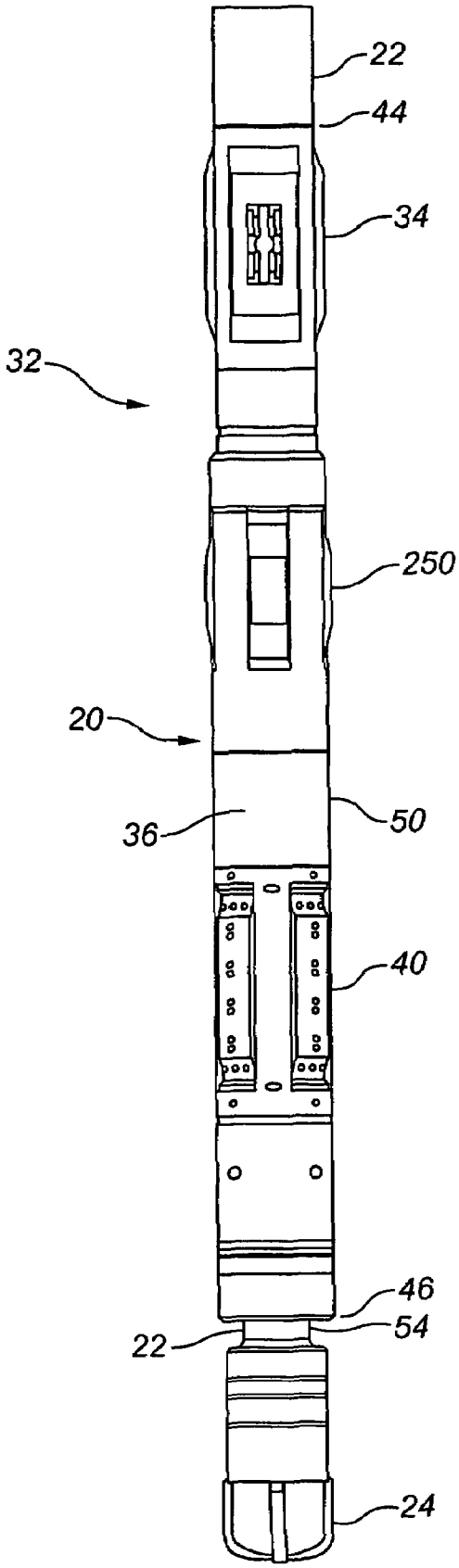
Figure 1C:
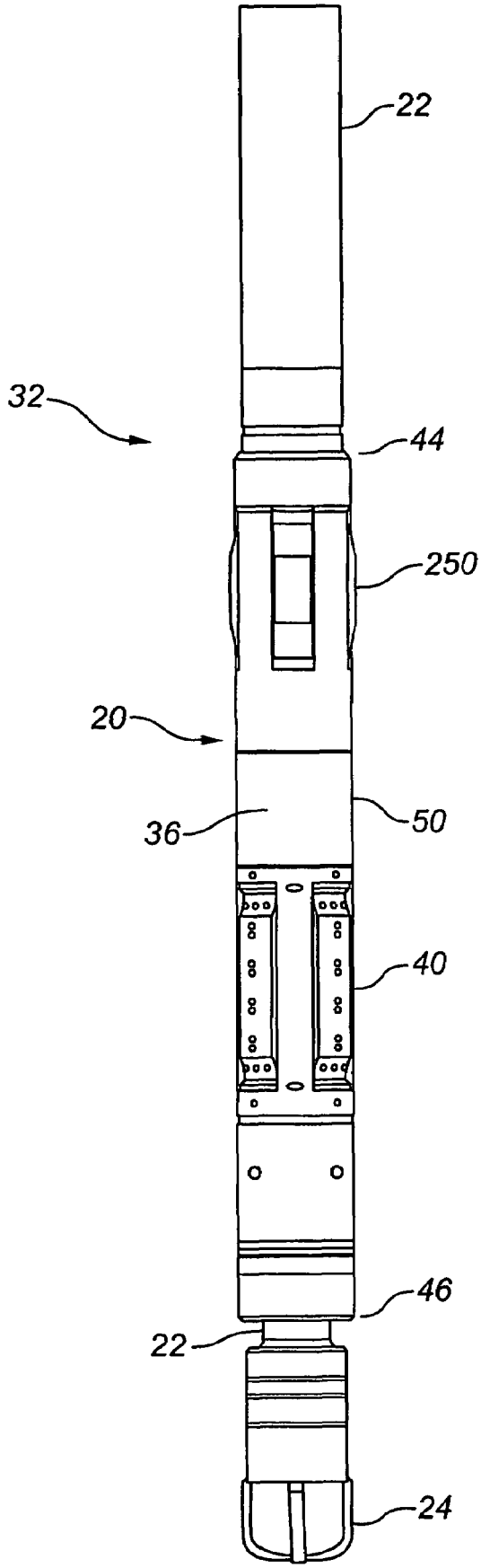

Referring to FIG. 1, a steering tool (20) according to the invention is depicted in three different exemplary configurations incorporated within a drill string (22). In all three exemplary configurations, a drill bit (24) is located at a distal end of the drill string (22).

In FIG. 1(*a*), the steering tool (20) is configured as a component of a drilling motor (26) having a motor housing (28) and a motor drive shaft (30). This configuration is described in detail below as a preferred embodiment of the invention.

In FIG. 1(*b*), the steering tool (20) is configured as a component of a rotary steerable drilling system (32) of the type in which a steering mechanism is rotatably connected with the drill string (22). In this configuration, the drill string (22) extends through the steering tool (20) and the steering tool (20) includes a borehole engaging device (34) for inhibiting the steering tool (20) from rotating in a borehole (not shown) when the drill string (22) is rotated.

In FIG. 1(*c*), the steering tool (20) is configured as a component of a fully rotating rotary steerable drilling system (32) of the type in which a steering mechanism is connected with the drill string (22) so that the steering mechanism rotates with the drill string (22). In this configuration, the steering tool (20) is fixedly connected within the drill string (22).

The principles of the invention are applicable to all of the configurations of the steering tool (20). A preferred embodiment of the invention in which the steering tool (20) is configured as a component of a drilling motor (26) is now described. In the preferred embodiment, the steering tool (20) is configured to maintain the drilling motor (26) in a vertical orientation as a target orientation. In other words, in the preferred embodiment the steering tool (20) is configured as a vertical steering tool.

In the preferred embodiment, the drilling motor (26) is comprised of a rotary motor so that the motor drive shaft (30) rotates relative to the motor housing (28) during operation of the drilling motor (26).

Figure 2:
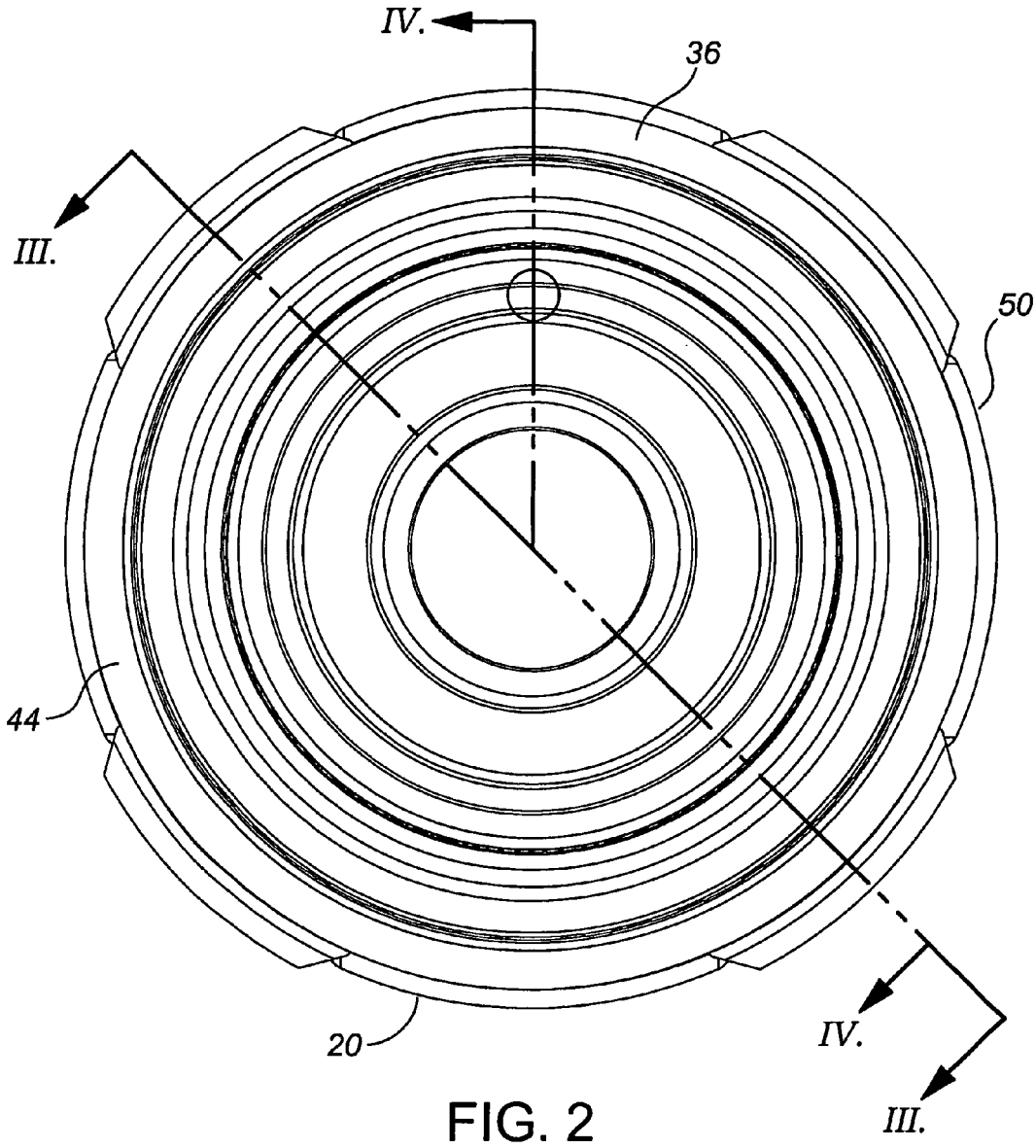
FIG. 2 is an end view of a steering tool according to a preferred embodiment of the invention corresponding to FIG. 1(*a*), looking from the upper end of the housing of the steering tool toward the lower end of the housing of the steering tool.
Figure 3A:
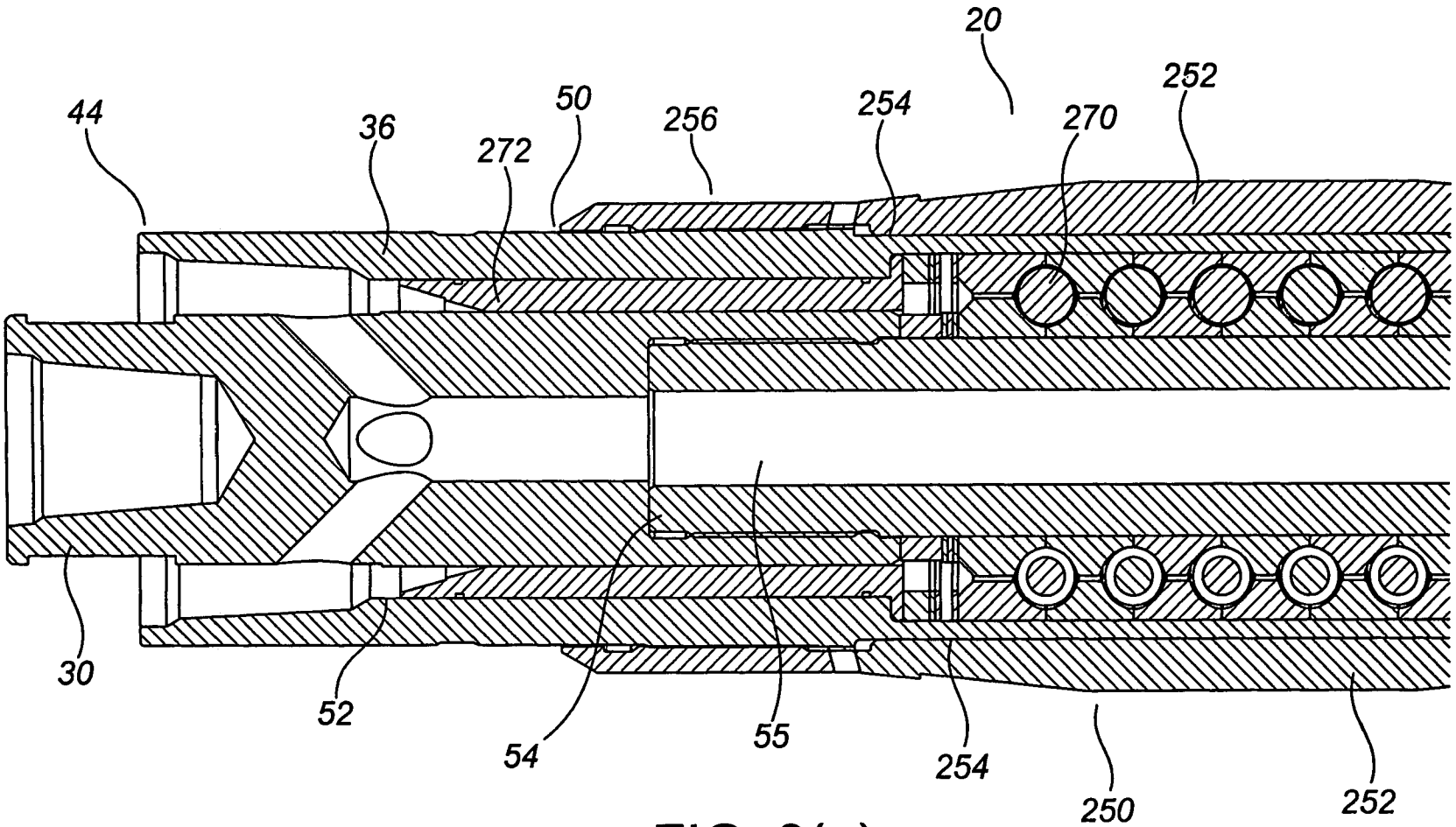
FIGS. 3(*a*)-3(*h*) are a longitudinal section assembly drawing of the steering tool of FIG. 2 taken along section line III-III, in which FIG. 3(*b*) through FIG. 3(*h*) are continuations of FIGS. 3(*a*) through 3(*g*) respectively.
Figure 3B:
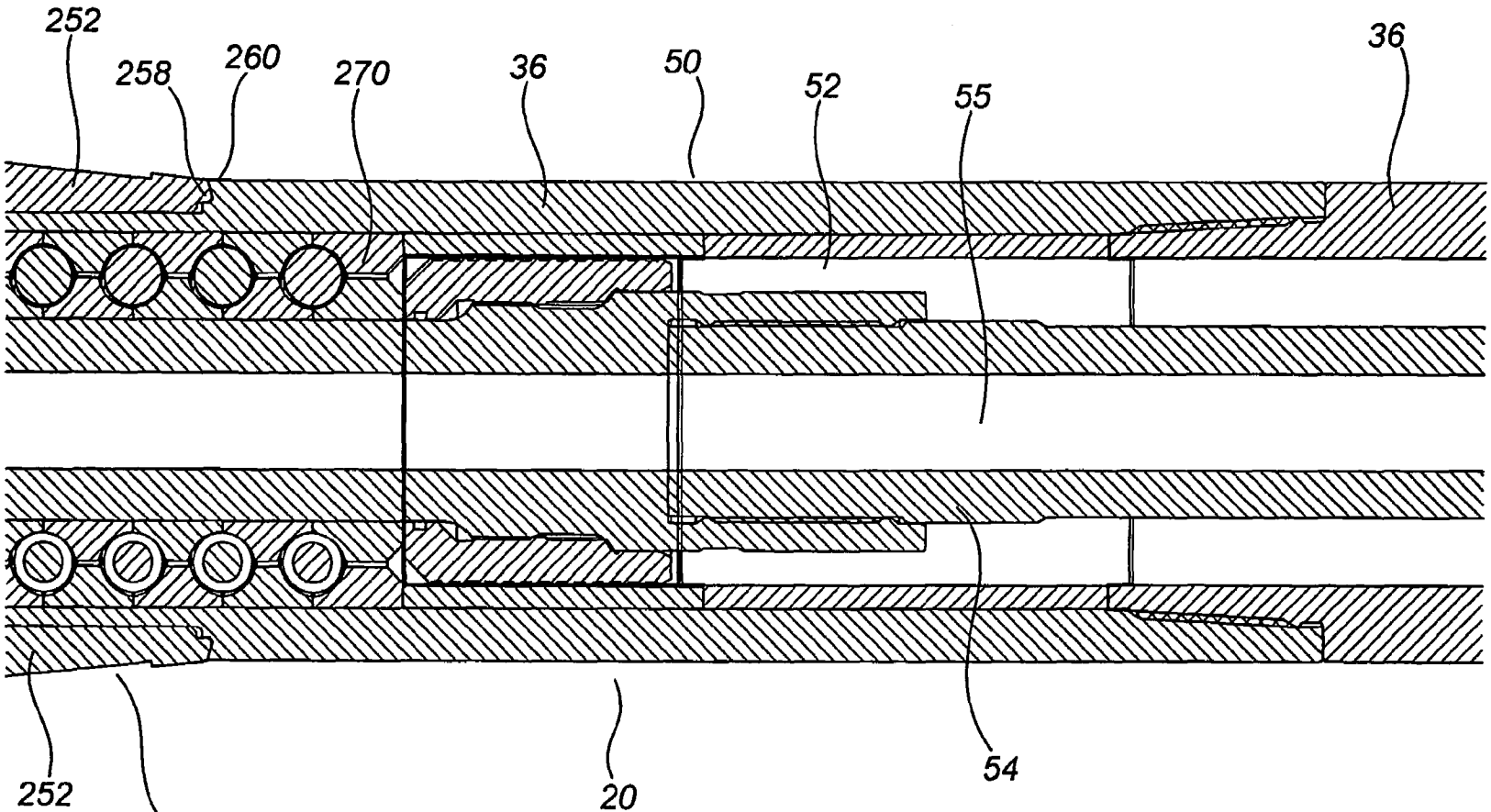
Figure 3C:
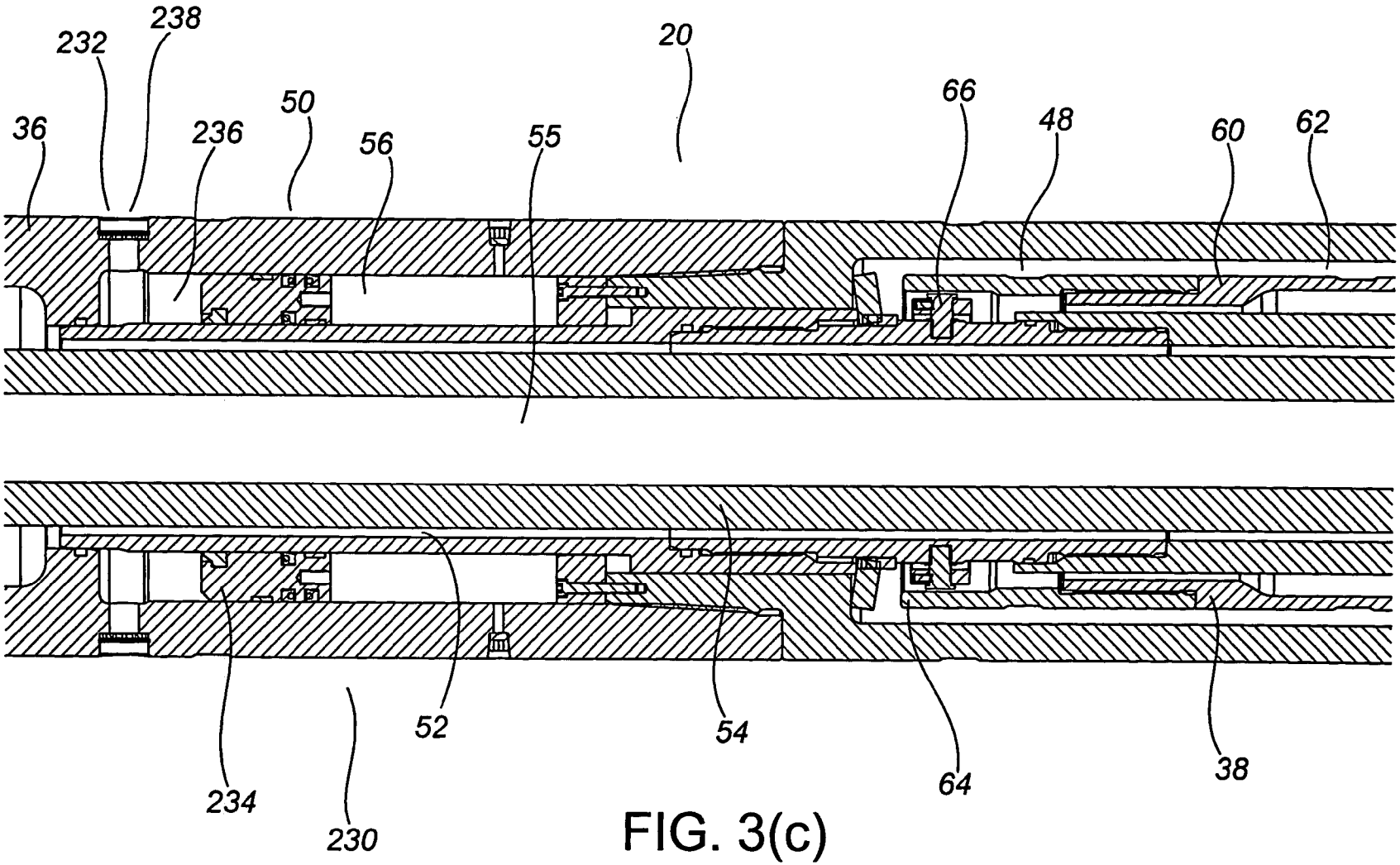
Figure 3D:
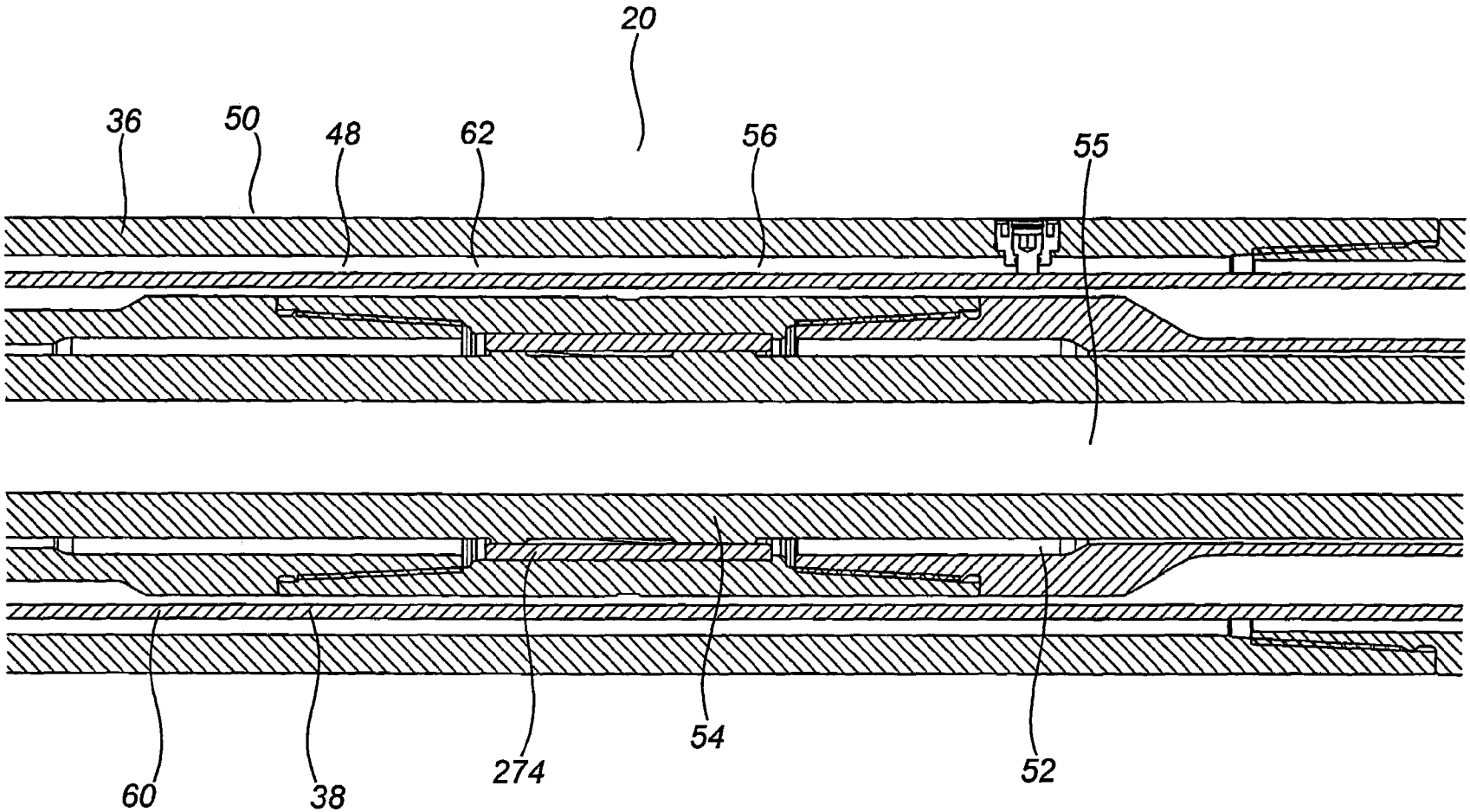
Figure 3E:
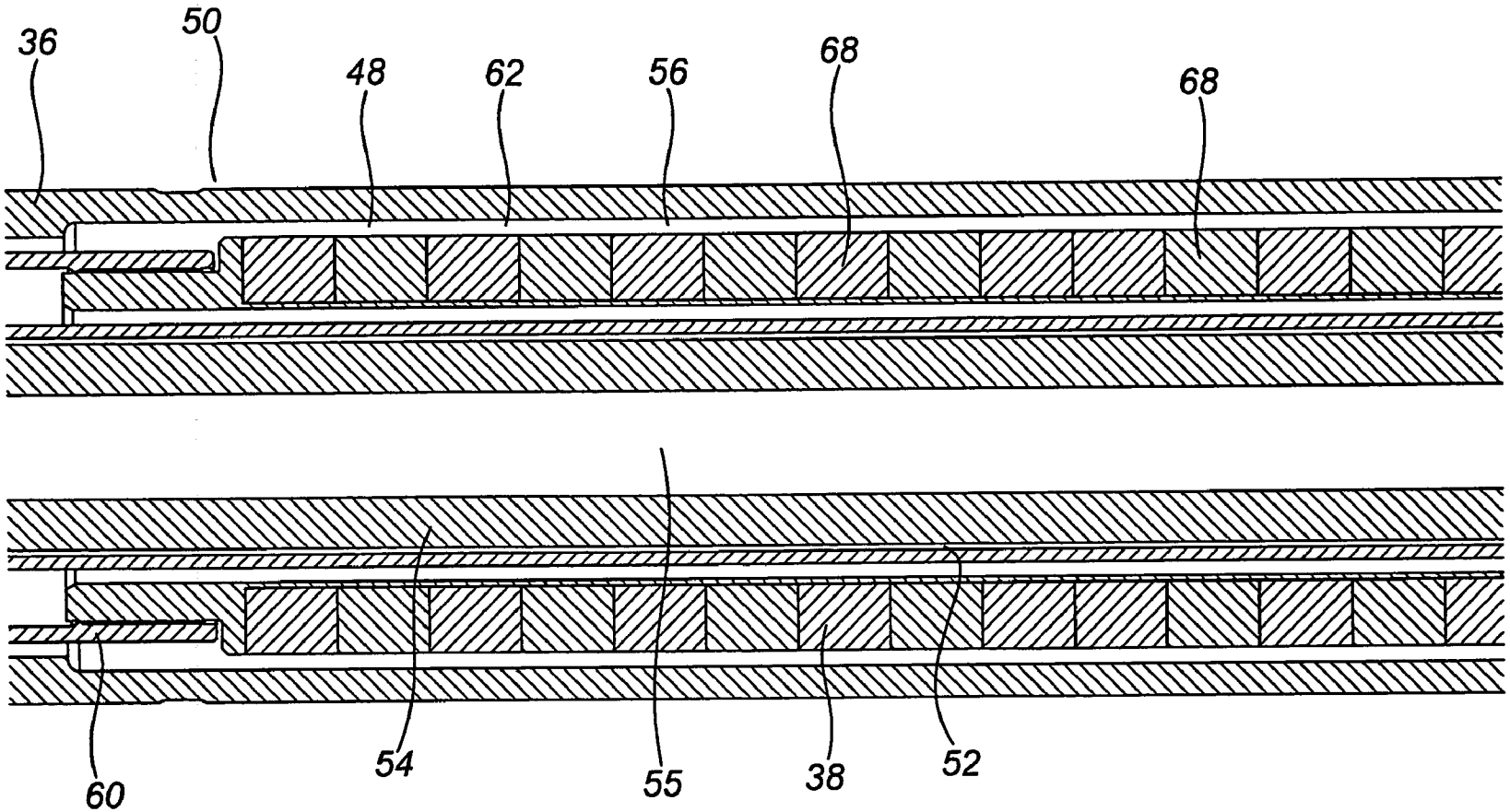
Figure 3F:
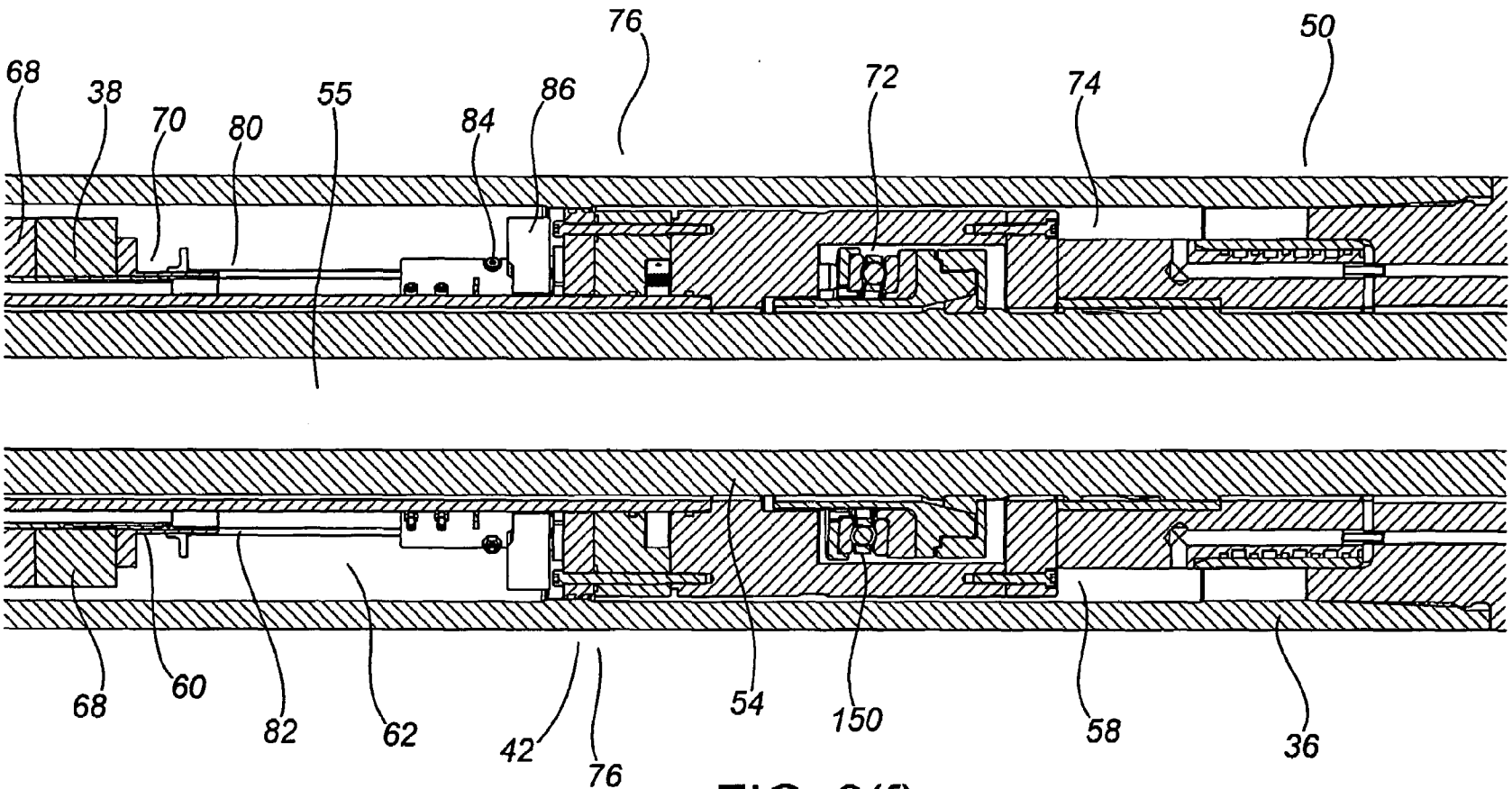
Figure 3G:
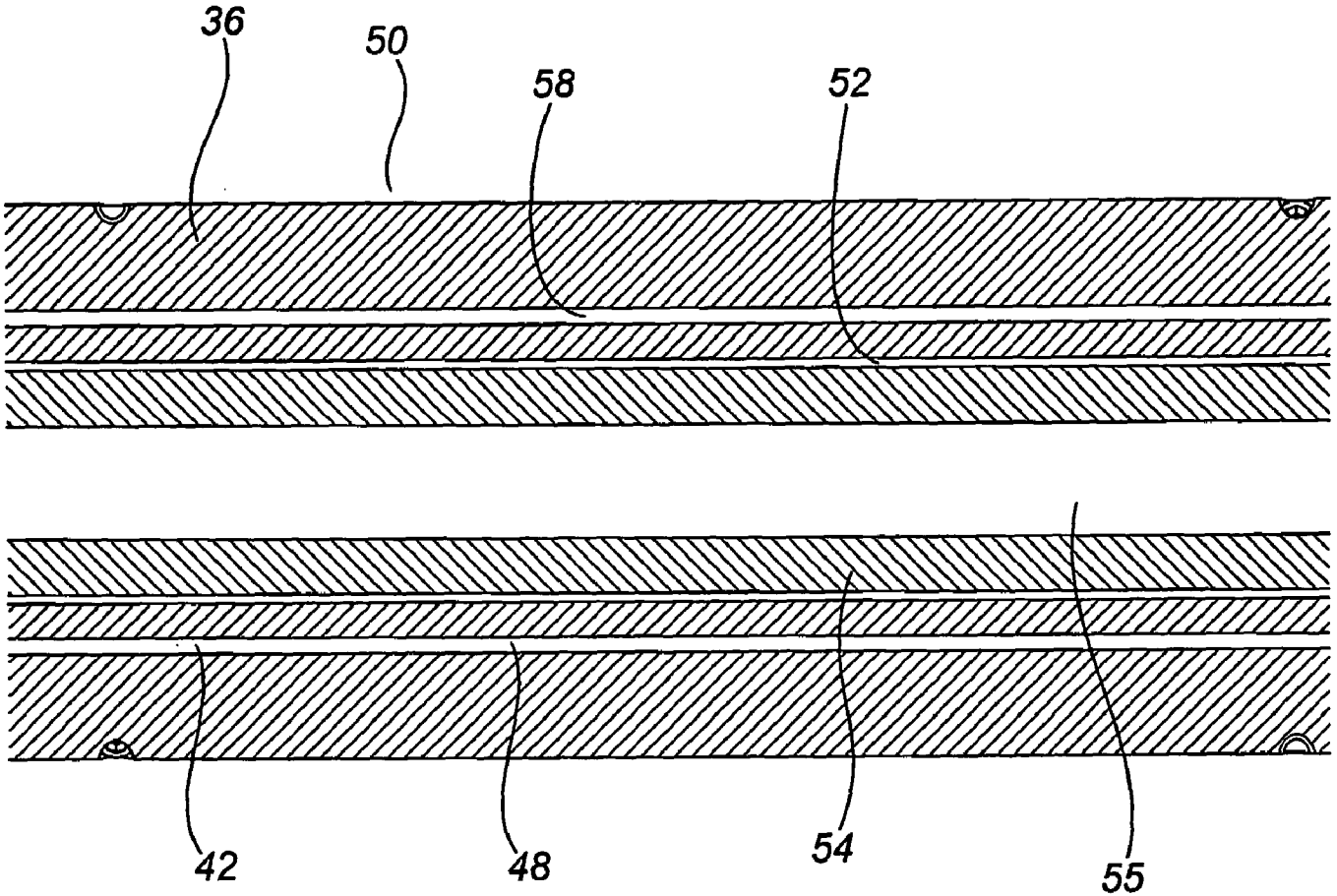
Figure 3H:
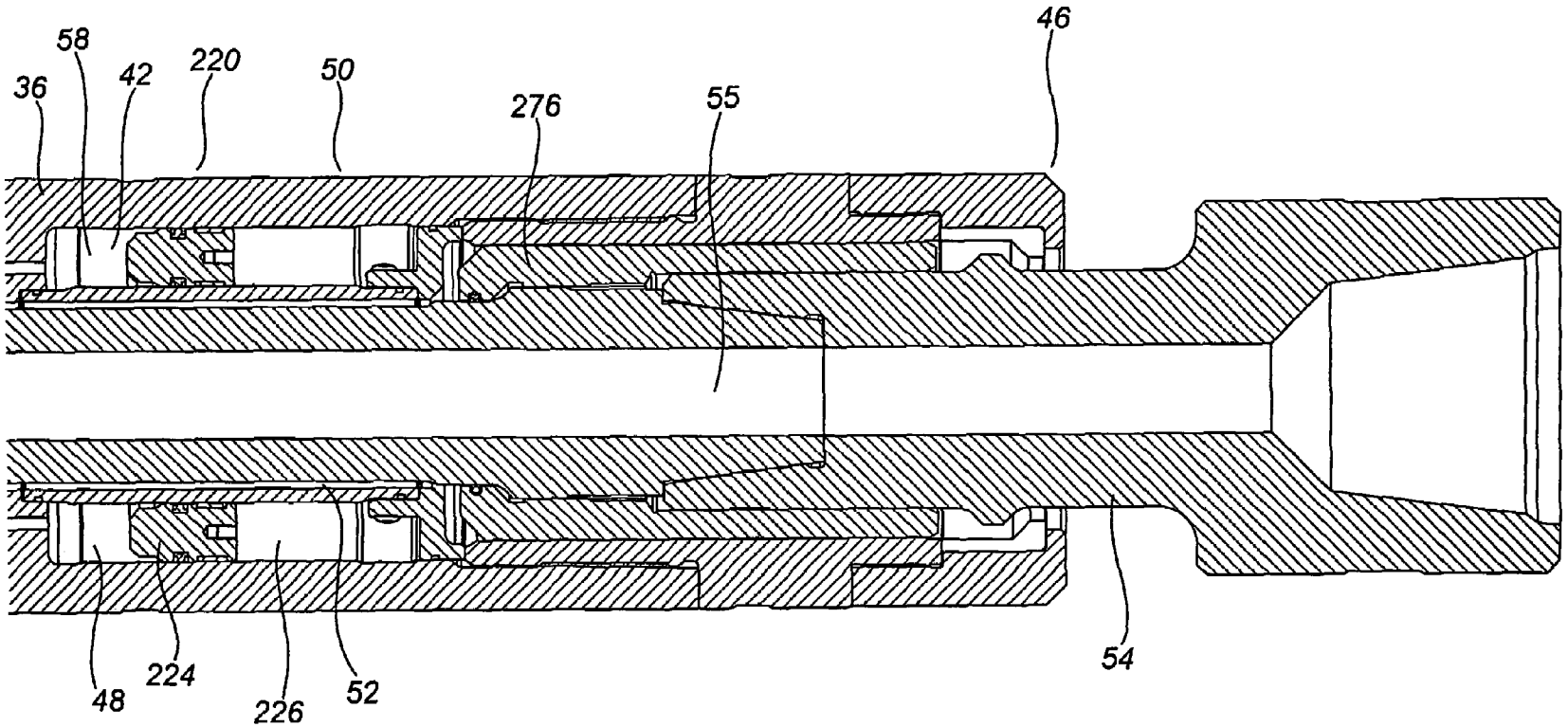
Figure 4A:
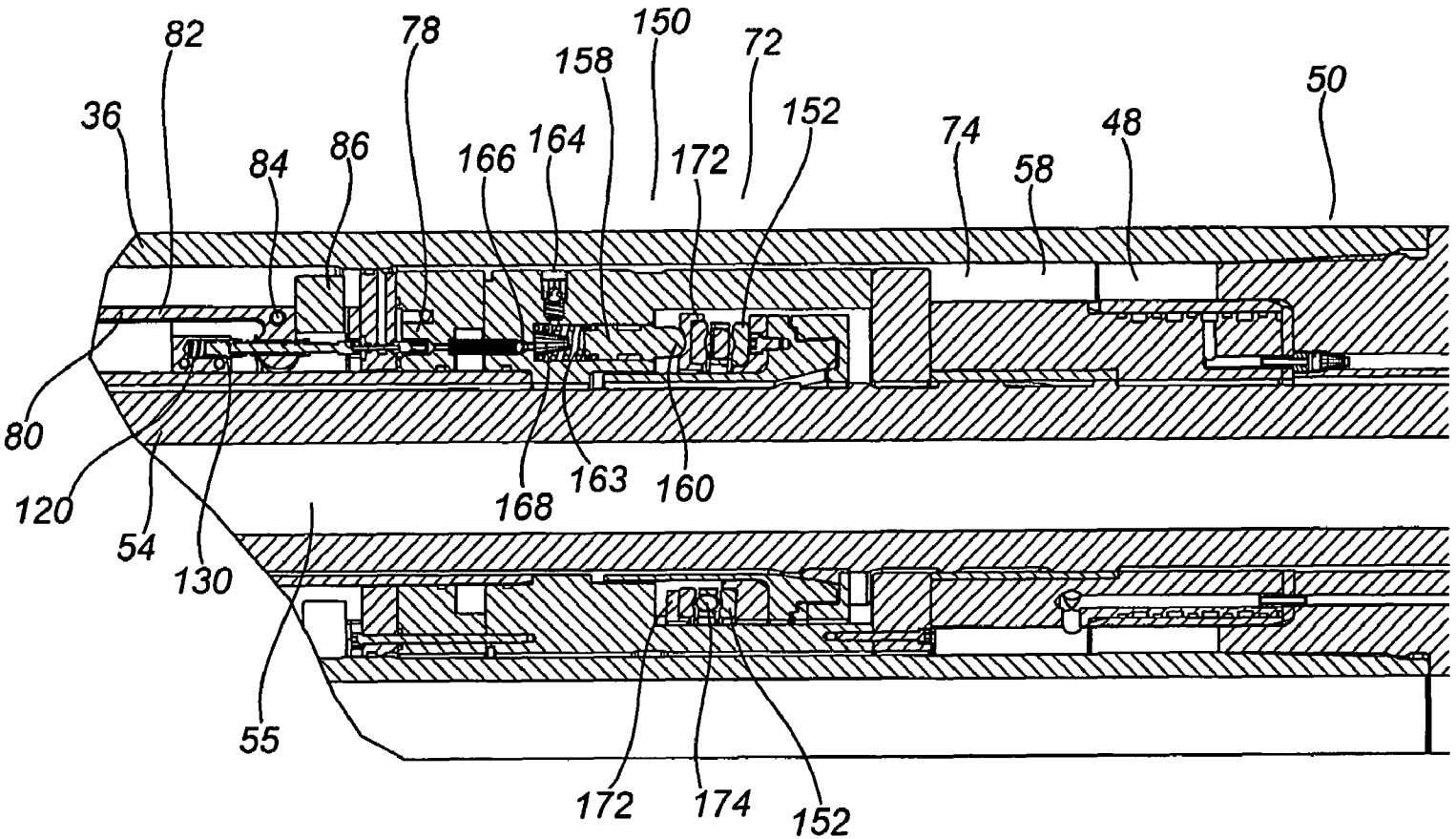
FIGS. 4(*a*)-4(*c*) are a partial longitudinal section assembly drawing of the steering tool of FIG. 2 taken along section line IV-IV, in which FIGS. 4(*b*) is a continuation of FIGS. 4(*a*) and FIG. 4(*c*) is a continuation of FIG. 4(*b*).
Figure 4B:
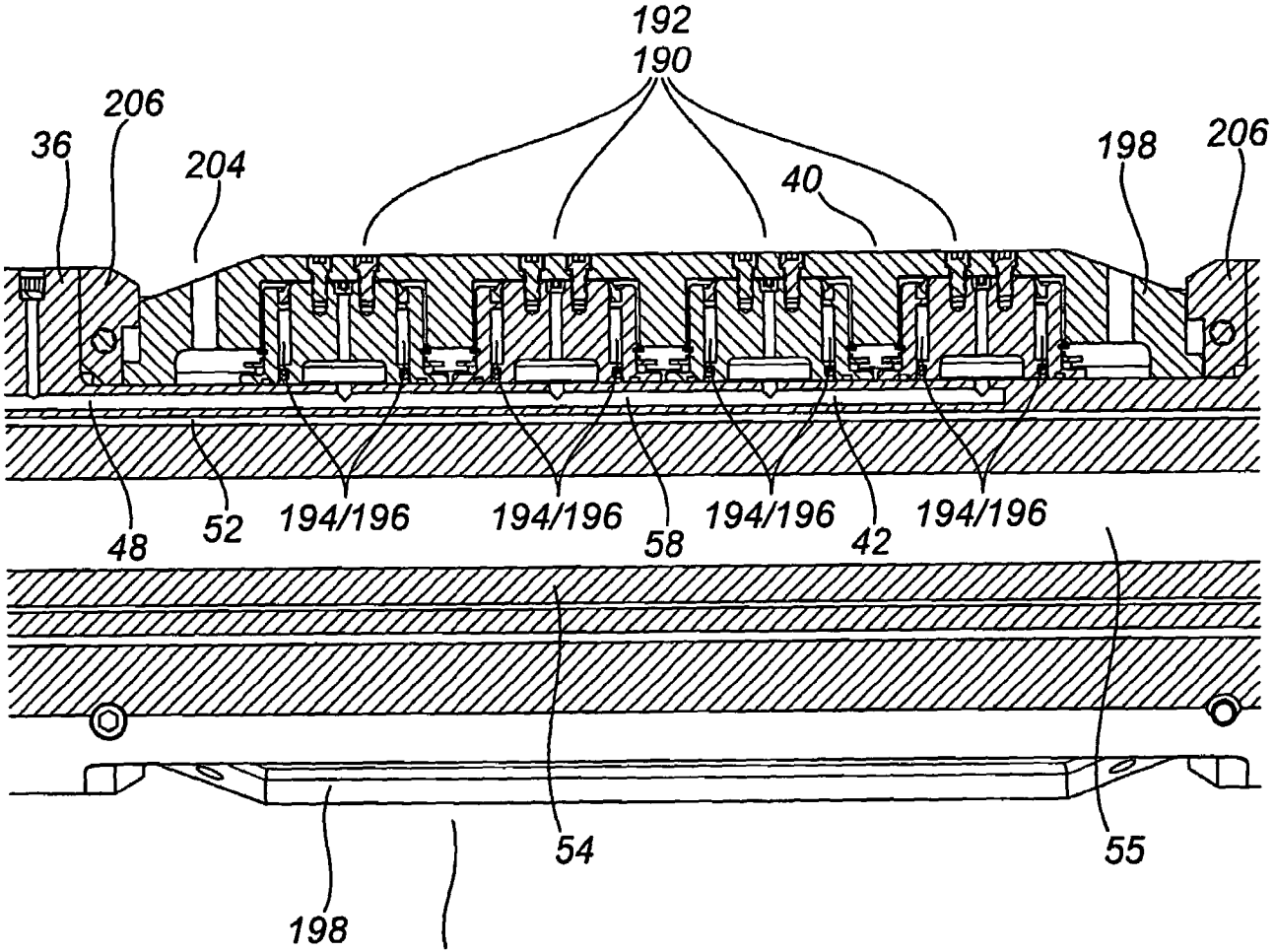
Figure 4C:
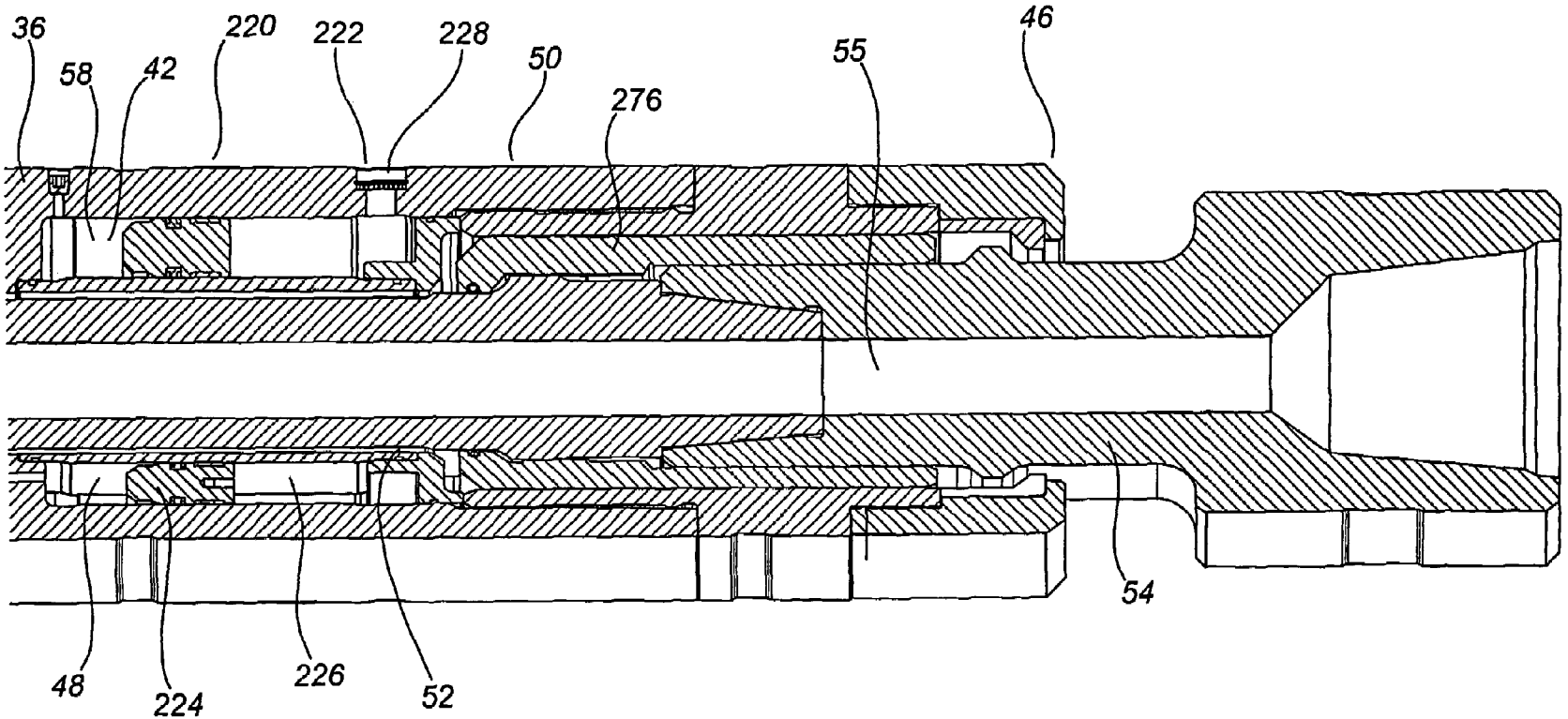

Referring to FIG. 3 and FIG. 4, longitudinal section views are provided of the steering tool (20) configured as a component of a drilling motor (26), taken along the section lines indicated in FIG. 2. As depicted in FIG. 3 and FIG. 4, the steering tool (20) is incorporated into the drilling motor (26) below the transmission section (not shown) of the drilling motor (26).

The steering tool is comprised of a tubular housing (36), a tool actuating device (38), a plurality of hydraulically actuated steering devices (40), and a hydraulic control system (42). The housing (36) has an upper end (44) and a lower end (46).

The upper end (44) of the housing (36) is adapted to provide a lower continuation of the motor housing (28). The housing (36) may be comprised of a single piece, but in the preferred embodiment the housing (36) is comprised of a plurality of sections connected together. The housing (36) may be formed with the motor housing (28) or may be otherwise connected with the motor housing (28).

In FIG. 3, the upper end (44) of the housing (36) is depicted as providing a threaded connection to the motor housing (28). The motor housing (28) is not depicted in FIG. 3.

The housing (36) has an interior (48), an exterior (50), and defines a housing bore (52). A shaft (54) extends through the housing bore (52) from the upper end (44) to the lower end (46) of the housing (36). The shaft (54) is adapted to provide a lower continuation of the motor drive shaft (30). The shaft (54) may be formed with the motor drive shaft (30) or may be otherwise connected with the motor drive shaft (30).

In FIG. 3, the shaft (54) at the upper end (44) of the housing (36) is depicted as providing a threaded connection to the motor drive shaft (30). The motor drive shaft (30) is not depicted in FIG. 3.

The shaft (54) extends from the lower end (46) of the housing (36). A drill bit (24) is connected to the shaft (54) adjacent to the lower end (46) of the housing (36).

The shaft (54) defines a shaft bore (55) for conducting drilling fluid (not shown) through the steering tool (20). A small amount of drilling fluid may also pass through the housing bore (52) in order to provide lubrication for some components of the steering tool (20). Portions of the interior (48) of the housing (36) are isolated from the exterior (50) of the housing (36) and from the housing bore (52) by seals positioned along the length of the housing (36).

The interior (48) of the housing (36) defines two compartments which are also isolated from each other. A first compartment (56) contains the tool actuating device (38). A second compartment (58) provides the hydraulic control system (42).

The tool actuating device (38) is comprised of a pendulum (60). The first compartment (56) is therefore comprised of a pendulum chamber (62). A proximal end (64) of the pendulum (60) is pivotably supported in the interior (48) of the housing (36) by a universal joint (66) which comprises two hinges located in perpendicular planes. The pendulum (60) pivots about the universal joint (66) in order to provide a pivoting movement as an actuating movement for actuating the steering devices (40).

In the preferred embodiment, the pendulum (60) is supported concentrically within the housing (36) so that the axis of the pendulum (60) is parallel with the axis of the housing (36) when the housing (36) is at a vertical orientation.

The pendulum (60) is comprised of a tubular member which is contained in the interior (48) of the housing so that it surrounds the housing bore (52). A plurality of carbide rings (68) are mounted on the pendulum (60) adjacent to a distal end (70) of the pendulum. The carbide rings (68) provide additional weight for the pendulum (60) to shift its center of gravity toward the distal end (70) and to increase an actuating force which is associated with the pivoting movement of the pendulum (60).

The pendulum chamber (62) is filled with a viscous medium (not shown) which provides viscous damping of the pivoting movement of the pendulum (60). In the preferred embodiment the viscous medium is comprised of a relatively high viscosity hydraulic oil such as, for example, Mobil™ SHC 639 lubricant.

The purpose of the hydraulic control system (42) is to convert the actuating movement of the pendulum (60) to independent actuation of the steering devices (40) between a retracted position and an extended position. The hydraulic control system (42) is comprised of a pressurization device (72), a reservoir (74) and a plurality of valve mechanisms (76).

The steering tool (20) is further comprised of a hydraulic fluid (not shown) for use in the hydraulic control system (42) in order to actuate the steering devices (40). In the preferred embodiment the hydraulic fluid is comprised of a relatively low viscosity hydraulic oil such as, for example, Mobil™ SHC 624 lubricant.

Figure 5:
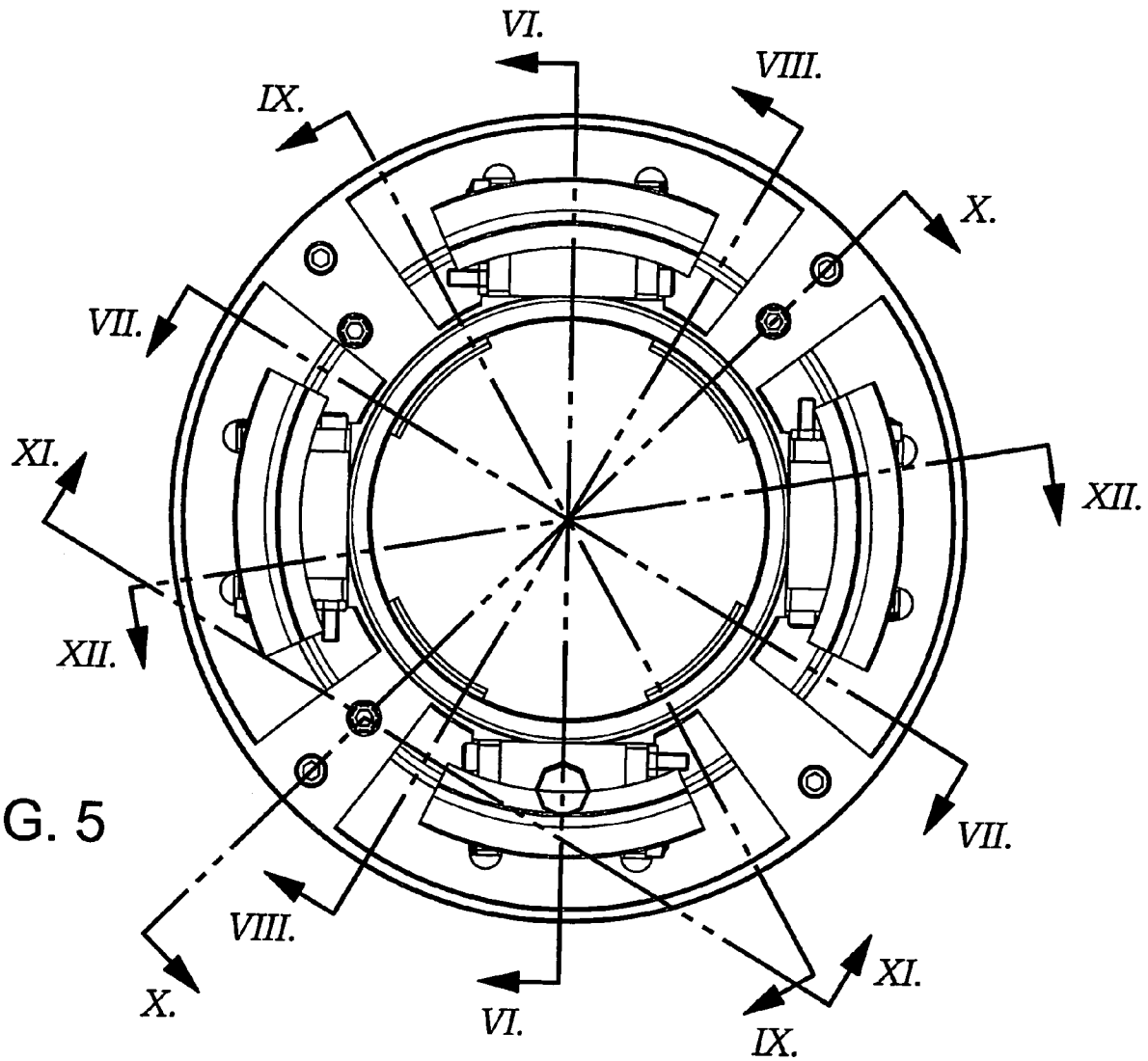
FIG. 5 is an end view of components of the hydraulic control system for the steering tool of FIG. 2.

Details of aspects of the hydraulic control system (42), including the pressurization device (72), the reservoir (74) and the valve mechanisms (76), are depicted in FIG. 3. Further details of aspects of the hydraulic control system (42) are also depicted in FIGS. 6-12, which provide longitudinal section views taken along the section lines indicated in FIG. 5.

The number of valve mechanisms (76) is equal to the number of steering devices (40) so that each of the valve mechanisms (76) is associated with the pendulum (60) and with one of the steering devices (40).

In the preferred embodiment the steering tool (20) includes four steering devices (40) and thus also includes four valve mechanisms (76). The four steering devices (40) are circumferentially spaced evenly about the exterior of the housing (36) so that their centerlines are separated by ninety degrees.

Figure 6:
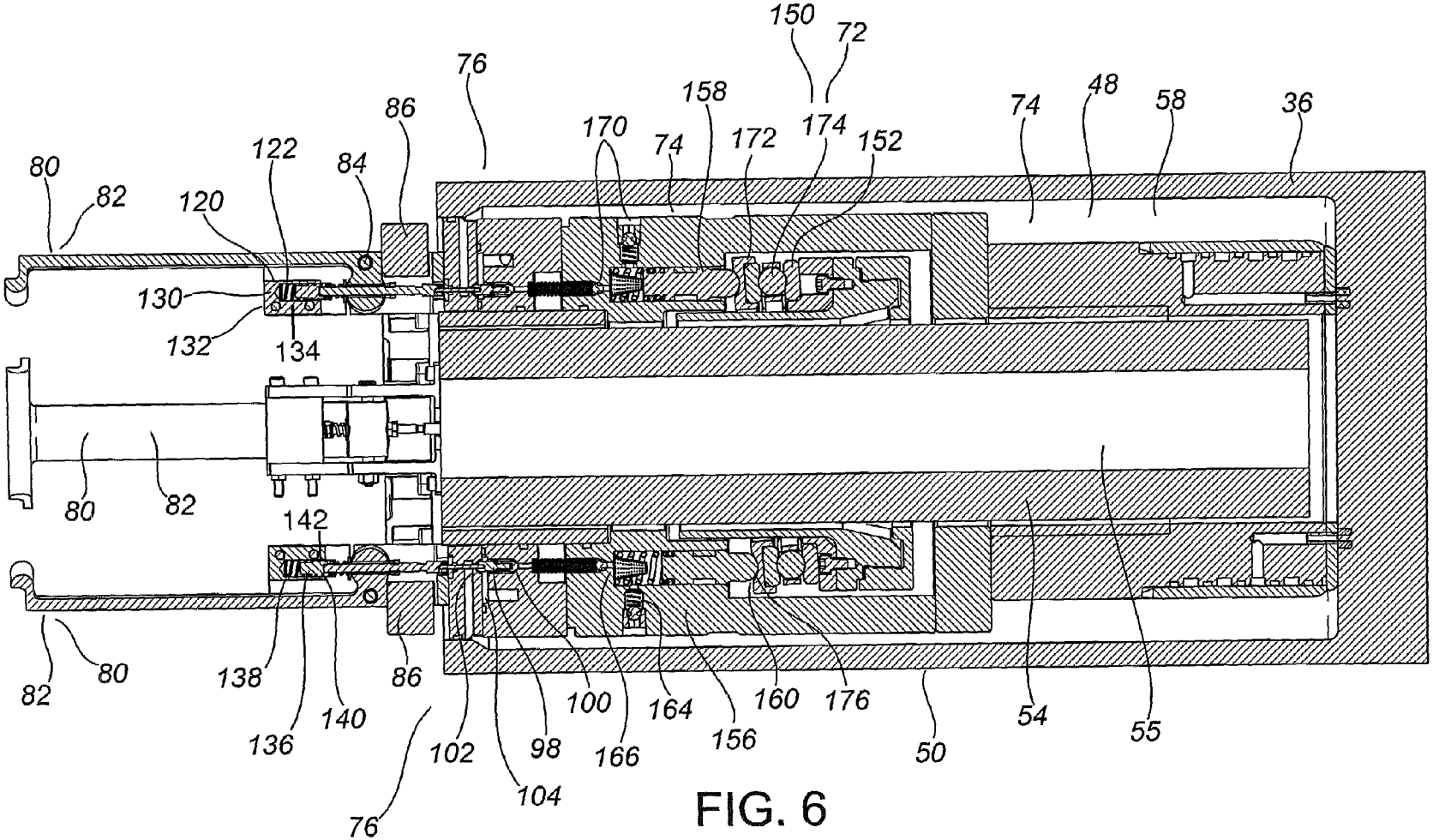
FIG. 6 is a longitudinal section assembly drawing of components of the hydraulic control system for the steering tool of FIG. 2, taken along section line VI-VI of FIG. 5.

Referring to FIG. 3 and FIG. 6, each of the valve mechanisms (76) is comprised of a valve (78) and a mechanical valve actuator (80). Each of the mechanical valve actuators (80) is comprised of an actuating lever (82). The actuating levers (82) are located in the interior (48) of the housing (36), are circumferentially spaced evenly about the interior (48) of the housing (36) so that their centerlines are separated by ninety degrees, and are located adjacent to the distal end (70) of the pendulum (60) so that they may be moved by the pivoting movement of the pendulum (60).

Although the centerlines of the actuating levers (82) are separated by ninety degrees, the actuating levers (82) each extend circumferentially about the interior of the housing (36) for about sixty degrees, with the result that a space of about thirty degrees separates the peripheral edges of the actuating levers (82) in the preferred embodiment.

Referring to FIG. 3 and FIG. 6, the actuating levers (82) pivot about a pivot point (84). In the preferred embodiment the actuating levers (82) are constructed of aluminum to reduce their weight and to minimize the centrifugal forces which are generated by the actuating levers (82) during rotation of the steering tool (20). The actuating levers (82) also include a counterweight (86) so that the actuating levers (82) are substantially balanced about the pivot point (84), thus reducing the tendency for the actuating levers (82) to pivot during rotation of the steering tool (20).

The actuating levers (82) are capable of being moved by the pendulum (60) between a first actuator position and a second actuator position. When the actuating levers (82) are in the first actuator position, their associated steering devices (40) are actuated to the retracted position. When the actuating levers (82) are in the second actuator position, their associated steering devices (40) are actuated to the extended position.

When the housing (36) is at a vertical orientation, with the result that the pendulum (60) is oriented so that its axis is parallel with the axis of the housing (36), the actuating levers (82) are all in the first actuator position. As a result, when the housing (36) is at a vertical orientation, all of the steering devices (40) are actuated to the retracted position.

When the housing (36) is at an orientation which deviates from the vertical orientation, with the result that the pendulum (60) is oriented so that its axis is not parallel with the axis of the housing (36), one or two of the actuating levers (82) are moved from the first actuator position toward the second actuator position. As a result, when the housing (36) is at an orientation which deviates from the vertical orientation, one or two of the steering devices (40) is actuated to the extended position.

In the preferred embodiment, a deviation of the housing (36) of at least about 0.183 degrees from a vertical orientation will result in one or two of the actuating levers (82) being moved to the second actuator position, thus causing full actuation of the steering tool (20).

The steering devices (40) and their associated mechanical valve actuators (80) are circumferentially offset from each other by substantially 180 degrees, with respect to the centerlines of the steering devices (40) and the mechanical valve actuators (80).

Movement of one of the actuating levers (82) from the first actuator position toward the second actuator position results in the operation of its associated valve (78) in order to provide communication between the pressurization device (72) and the steering device (40) which is associated with the particular valve mechanism (76).

In the preferred embodiment, the hydraulic control system (42) is a "single-acting" hydraulic system which includes only a single communication path between the valve (78) and its associated steering device (40). As a result, the steering devices (40) in the preferred embodiment of the hydraulic control system (42) are actively actuated to the extended position but are passively actuated back to the retracted position.

As depicted in FIG. 3 and FIG. 6, each valve (78) is a single shuttle valve which includes a valve body (98) which reciprocates between seating against a pressurized hydraulic fluid port (100) and a reservoir port (102) in response to movement of the mechanical valve actuator (80). When the mechanical valve actuator (80) is in the first actuator position, the valve body (98) is seated against the pressurized hydraulic fluid port (100) so that the steering device (40) communicates via a steering device port (104) only with the reservoir (74) via the reservoir port (102). When the mechanical valve actuator (80) is in the second actuator position, the valve body (98) is seated against the reservoir port (102) so that the steering device (40) communicates via the steering device port (104) only with the pressurization device (72) via the pressurized hydraulic fluid port (100). When the mechanical valve actuator (80) is between the first actuator position and the second actuator position, the valve body (98) is not seated against either port (100,102), with the result that the steering device (40) communicates via the steering device port (104) with both the reservoir (74) and the pressurization device (72).

Grooves or channels in the components of the housing (36) provide conduits between the ports (100,102,104) and the pressurization device (72), the reservoir (74) and the steering devices (40) respectively.

Figure 13:
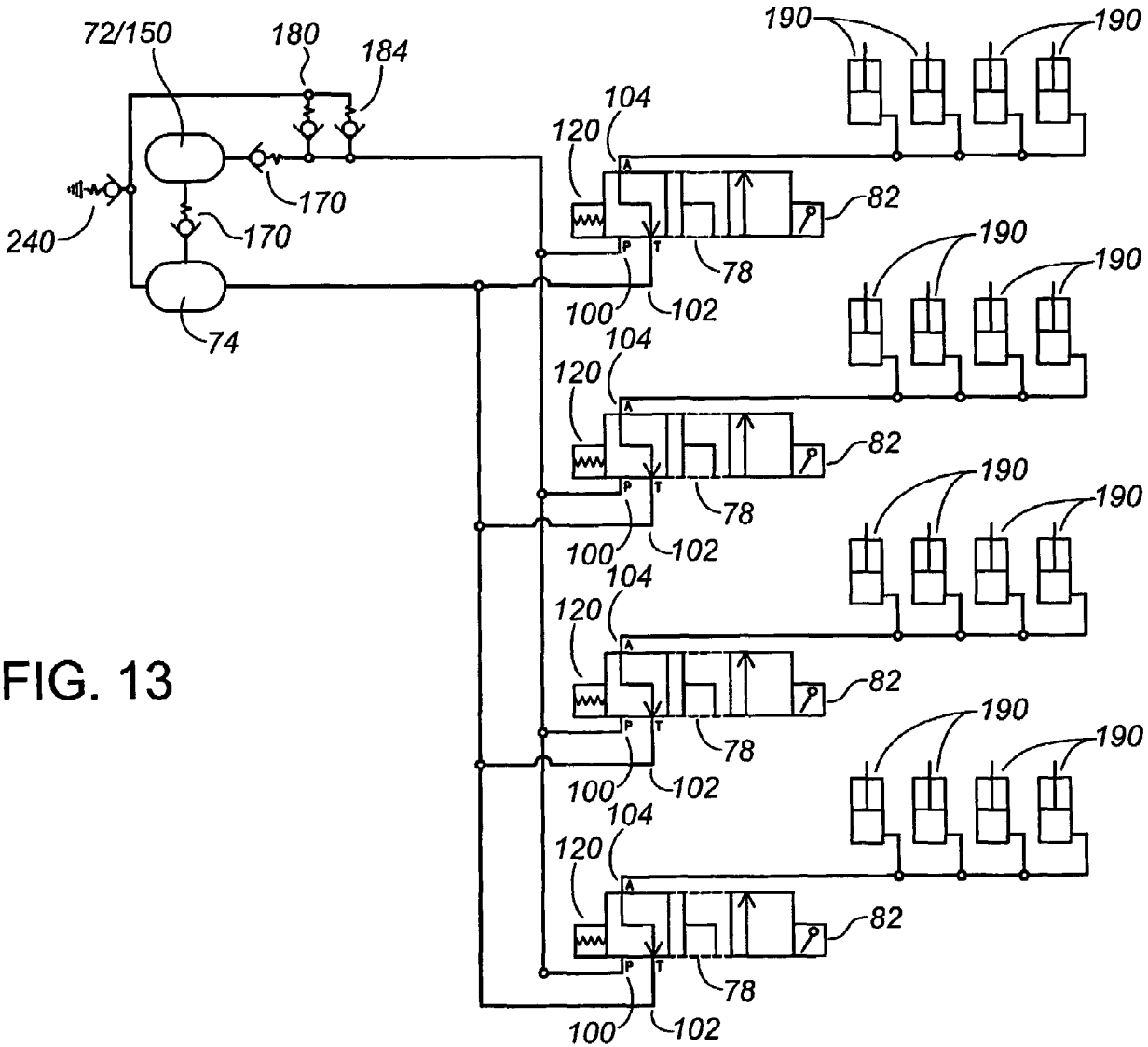
FIG. 13 is a schematic drawing of components of the hydraulic control system for the steering tool of FIG. 2 in which the hydraulic control system is a single-acting hydraulic system.
Figure 14:
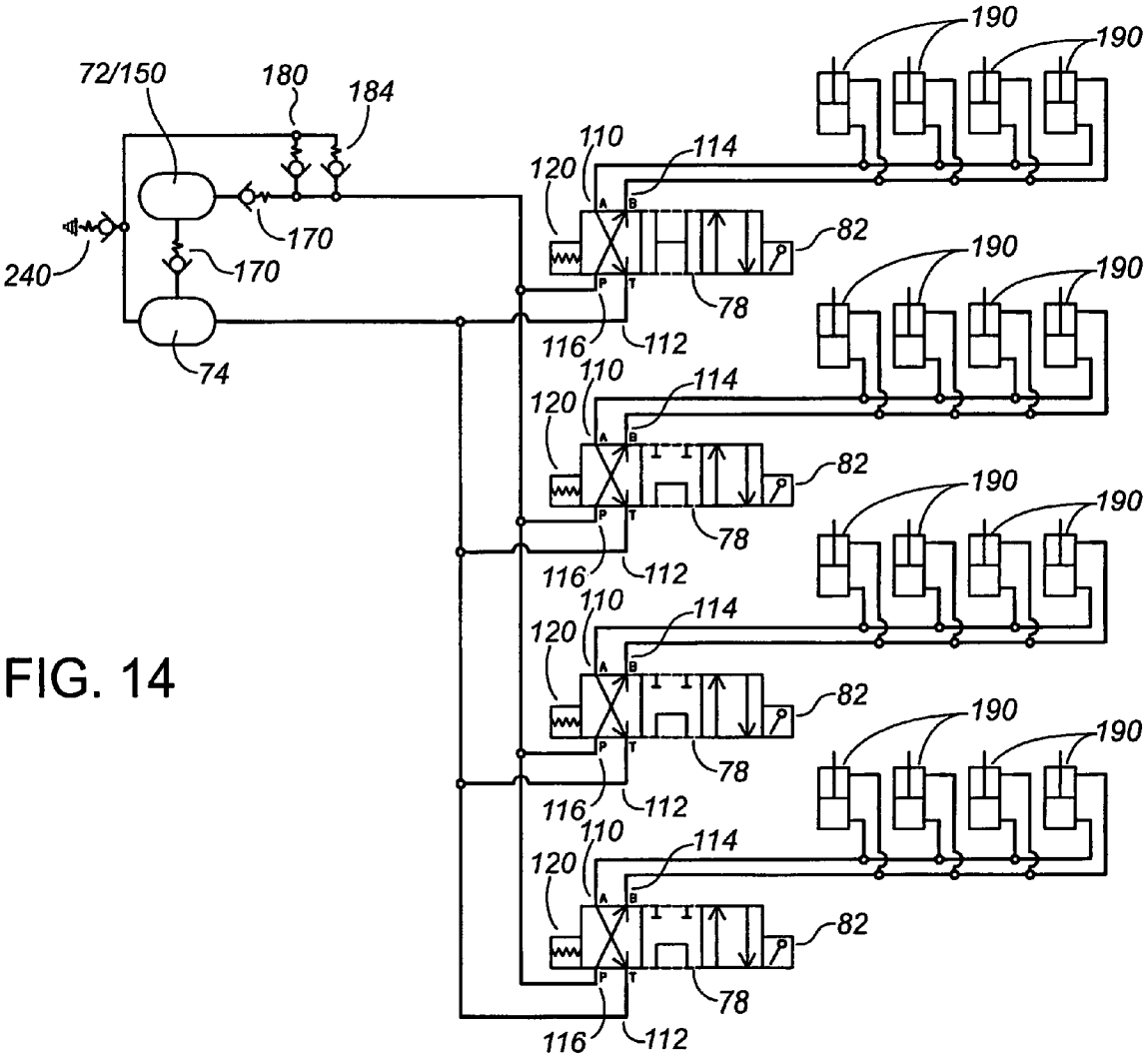
FIG. 14 is a schematic drawing of components of an alternate embodiment of hydraulic control system for use in the steering tool of FIG. 2 in which the hydraulic control system is a double-acting hydraulic system.
Figure 15:
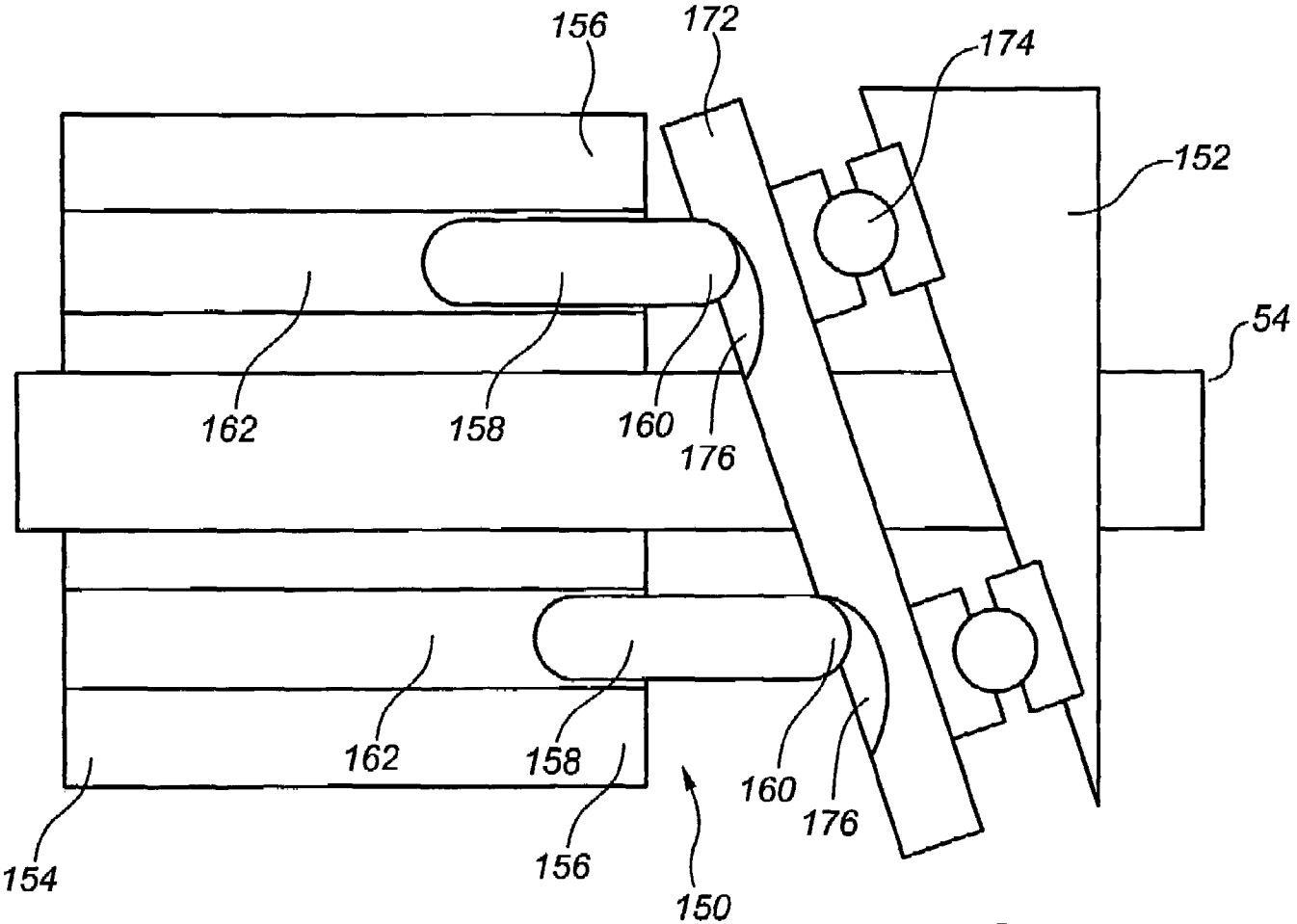
FIG. 15 is a schematic side view of the swash plate pump for the steering tool of FIG. 2.

The hydraulic control system (42) of the preferred embodiment is depicted schematically in FIG. 13. In FIG. 14, an alternate embodiment of the hydraulic control system (42) is depicted schematically.

In the alternate embodiment of the hydraulic control system (42) depicted in FIG. 14, the hydraulic control system (42) is a "double-acting" hydraulic system which includes two communication paths between the valve (78) and its associated steering device (40). As a result, the steering devices (40) in the alternate embodiment of the hydraulic control system (42) are actively actuated to both the extended position and the retracted position.

In the alternate embodiment of the hydraulic control system (42) depicted in FIG. 14, each valve (78) is preferably comprised of a valve with four ports, such as a single spindle valve, in which the valve body (98) reciprocates between positions in which different combinations of pairs of ports are in communication with each other in response to movement of the mechanical valve actuator (80).

In the alternate embodiment, when the mechanical valve actuator (80) is in the first actuator position, the steering device (40) communicates via a first steering device port (110) with the reservoir (74) via a reservoir port (112) and the steering device (40) communicates via a second steering device port (114) with the pressurization device (72) via a pressurized hydraulic fluid port (116). When the mechanical valve actuator (80) is in the second actuator position, the steering device (40) communicates via the first steering device port (110) with the pressurization device (72) via the pressurized hydraulic fluid port (116) and the steering device (40) communicates via the second steering device port (114) with the reservoir (74) via the reservoir port (112).

Grooves or channels in the components of the housing (36) provide conduits between the ports (110,114) and the steering devices (40) and between the ports (112,116) and the reservoir (74) and the pressurization device (72) respectively.

In all embodiments of the hydraulic control system (42), each of the valves (78) is preferably comprised of a device which is not pressure dependent in its operation. For example, a shuttle valve, in which the ends of the valve body engage the ports in order to seat the valve body, may be advantageous due to its simplicity. However, a shuttle valve is also pressure dependent in its operation because the pressures at the pressurized hydraulic fluid port (100) and the reservoir port (102) act on the valve body (98) in directions which are parallel to the reciprocation of the valve body (98).

In contrast, a spindle valve, in which the ports are arranged along the sides of the valve body and the valve body includes one or more grooves or necks to allow fluid to pass by the valve body, is not pressure dependent in its operation because the pressures at the pressurized hydraulic fluid port (100) and the reservoir port (102) act on the valve body (98) in directions which are perpendicular to the reciprocation of the valve body (98). As a result, although shuttle valves are depicted as the valves (78) in the preferred embodiment, spindle valves may be more preferred if pressure dependency of the valves (78) is to be avoided.

Referring to FIG. 3 and FIG. 6, each of the valve mechanisms (76) is further comprised of a valve mechanism biasing device (120) for biasing the mechanical valve actuator (80) toward the first actuator position. In the preferred embodiment the valve mechanism biasing device (120) is comprised of a spring (122) which is associated with the shuttle valve.

Referring to FIG. 3 and FIG. 6, each of the valve mechanisms (76) is further comprised of a mechanical actuator dampening mechanism (130) for dampening the movement of the mechanical valve actuator (80). In the preferred embodiment, the mechanical actuator dampening mechanism (130) is comprised of a fluid metering device (132) which is operably connected with the mechanical valve actuator (80). The fluid metering device (132) is comprised of a dampening cylinder (134) and a metering piston (136) reciprocably contained in the dampening cylinder (134) so that the dampening cylinder (134) is divided into a first chamber (138) and a second chamber (140). The metering piston (136) is undersized relative to the dampening cylinder (134) so that a restricted flowpath (142) is provided between the first chamber (138) and the second chamber (140) as the metering piston (136) reciprocates relative to the dampening cylinder (134) as a result of movement of the mechanical valve actuator (80).

The pressurization device (72) draws the hydraulic fluid from the reservoir (74) in order to provide a supply of pressurized hydraulic fluid. As a result, the reservoir (74) is designed to have a reservoir pressure which is lower than a pressure of the pressurized hydraulic fluid which is provided by the pressurization device (72).

In the preferred embodiment, the pressurization device (72) is comprised of a swash plate pump (150). Referring to FIGS. 3-4 and FIGS. 15-16, the swash plate pump (150) is comprised of a swash plate (152) and a cylinder (154) which are associated with the shaft (54) and the housing (36) respectively.

Figure 16:
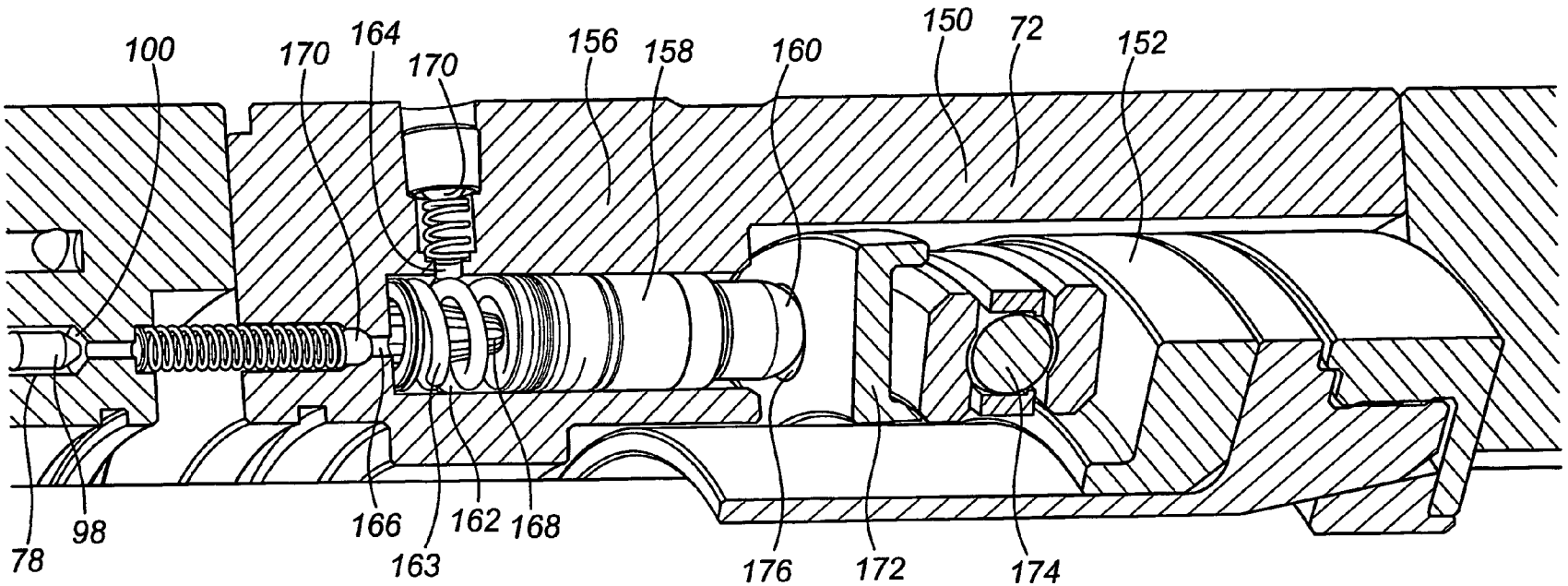
FIG. 16 is a partial pictorial view of the swash plate pump for the steering tool of FIG. 2.

The swash plate (152) is connected with the shaft (54) so that the swash plate (152) rotates with the shaft (54). As depicted in FIGS. 3-4 and FIG. 16, the swash plate (152) is fixedly connected with the shaft (54) so that the swash plate (152) moves axially with the shaft (54). More preferably, however, the swash plate (152) is connected with the shaft (54) using splines (not shown) so that the swash plate (152) can move axially relative to the shaft (152) in order to compensate for wear in the steering tool (20) which may cause the shaft (54) to move axially relative to the cylinder (154).

The cylinder (154) is fixed to the housing (36) so that the swash plate (152) rotates relative to the cylinder (154) as the shaft (54) rotates. The cylinder (154) is comprised of an array of piston assemblies (156) which are spaced circumferentially around the cylinder (154). Each of the piston assemblies (156) is comprised of a piston (158) and a reciprocable actuator surface (160) which is associated with the piston (158) for causing reciprocation of the piston (158).

Referring to FIGS. 3-4 and FIGS. 6-7, each of the pistons (158) is contained in a pumping chamber (162) so that the piston (158) may reciprocate in the pumping chamber (162) in order to pressurize the hydraulic fluid and provide the pressurized hydraulic fluid. A spring (163) is provided in the pumping chamber (162) to bias the piston (158) and the actuator surface (160) toward the swash plate (152).

The swash plate pump (150) is further comprised of a pump inlet (164) which communicates with the reservoir (74) and a pump outlet (166) which communicates with the valve (78) via the pressurized hydraulic fluid port (100). A filter (168) is provided at the pump outlet (166) to filter the hydraulic fluid which is delivered by the swash plate pump (150) to the pressurized hydraulic fluid port (100). The pump inlet (164) and the pump outlet (166) are both provided with pump check valves (170) which are biased toward a seated position by springs.

Referring to FIGS. 3-4 and FIGS. 15-16, the swash plate (152) is comprised of an angled profile. The swash plate pump (150) is further comprised of a stationary plate (172) which is rotatably and pivotably connected by a bearing (174) with the angled profile on the swash plate (152). The stationary plate (172) is connected with the housing (36) so that the stationary plate (174) does not rotate relative to the housing (36).

The stationary plate (174) defines a plurality of engagement surfaces (176) for engaging the actuator surfaces (160) as the actuator surfaces (160) are biased toward the stationary plate (174). In the preferred embodiment the engagement surfaces (176) are comprised of dimples or depressions which are complementary to the actuator surfaces (160).

During rotation of the swash plate (152) with the shaft (54), the stationary plate (172) does not rotate, but pivots as it follows the angled profile of the swash plate (152). The actuator surfaces (160) remain in engagement with the engagement surfaces (176) on the stationary plate, causing the pistons (158) to reciprocate in the pumping chambers (162), thus causing the hydraulic fluid to be drawn from the reservoir (74) and pressurized by the swash plate pump (150) to provide the pressurized hydraulic fluid.

The swash plate (152), the stationary plate (172) and the bearing (174) are lubricated by drilling fluid which passes through the housing bore (52) between the housing (36) and the shaft (54).

Figure 7:
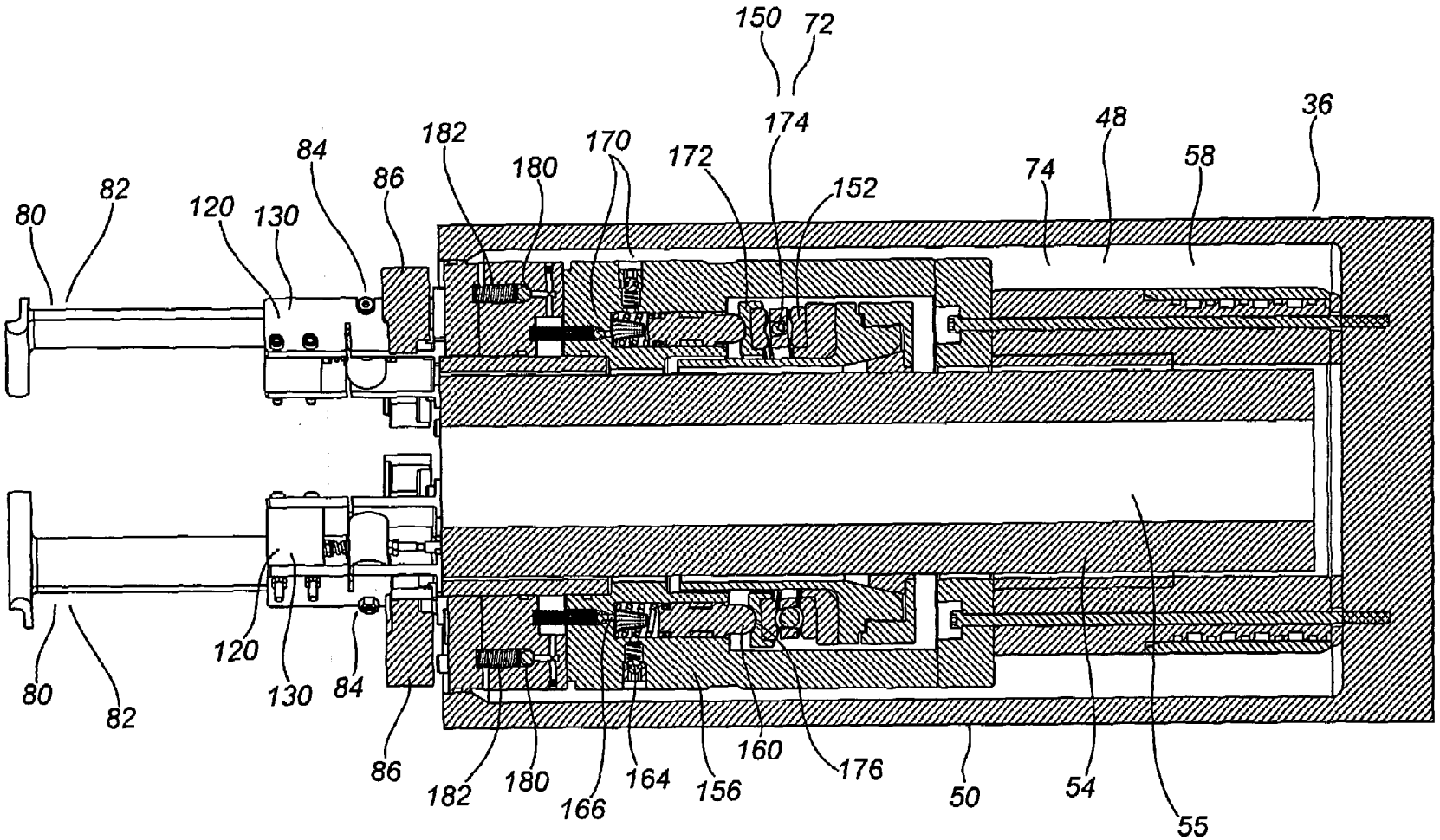
FIG. 7 is a longitudinal section assembly drawing of components of the hydraulic control system for the steering tool of FIG. 2, taken along section line VII-VII of FIG. 5.
Figure 8:
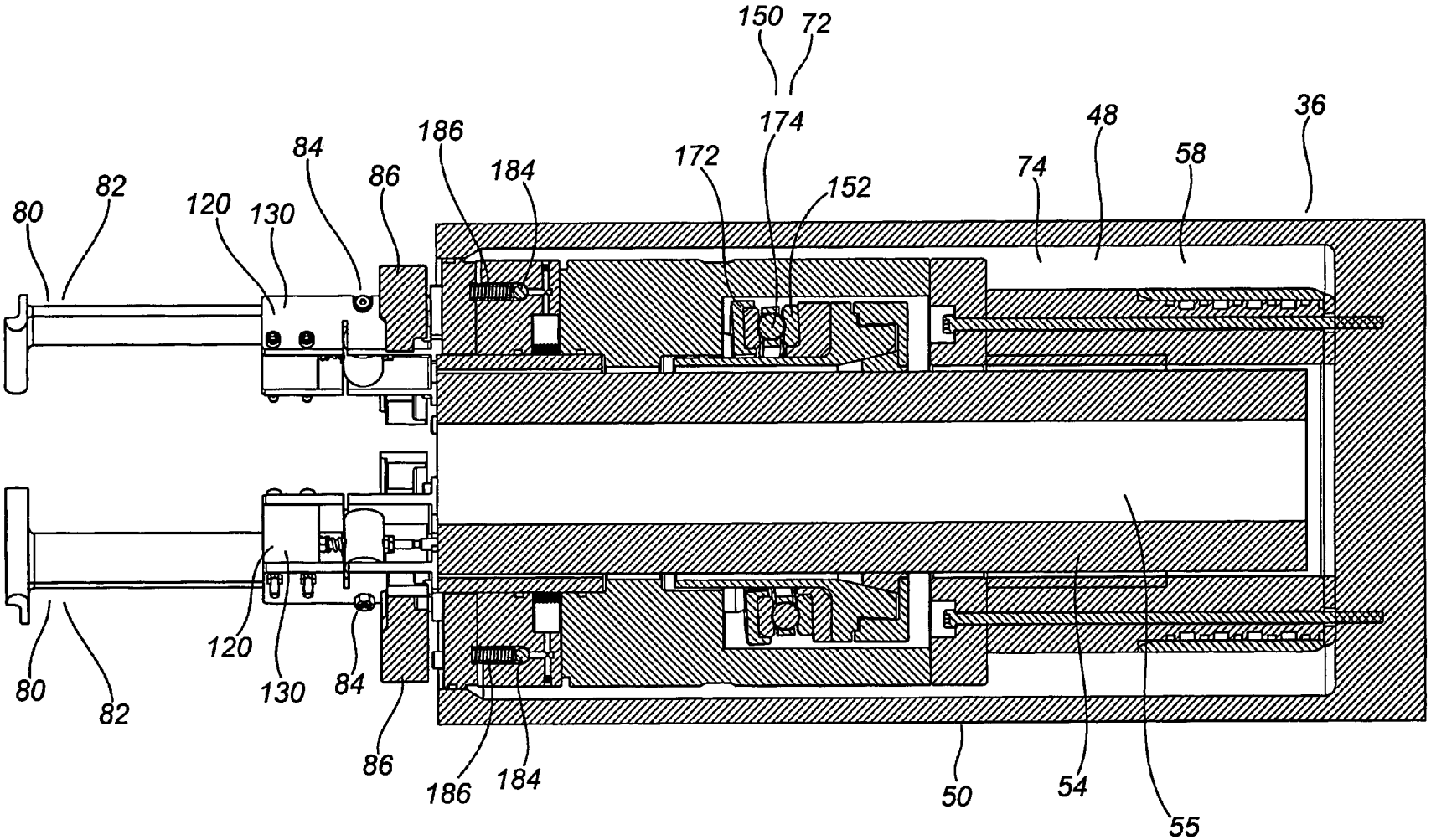
FIG. 8 is a longitudinal section assembly drawing of components of the hydraulic control system for the steering tool of FIG. 2, taken along section line VIII-VIII of FIG. 5.
Figure 9:
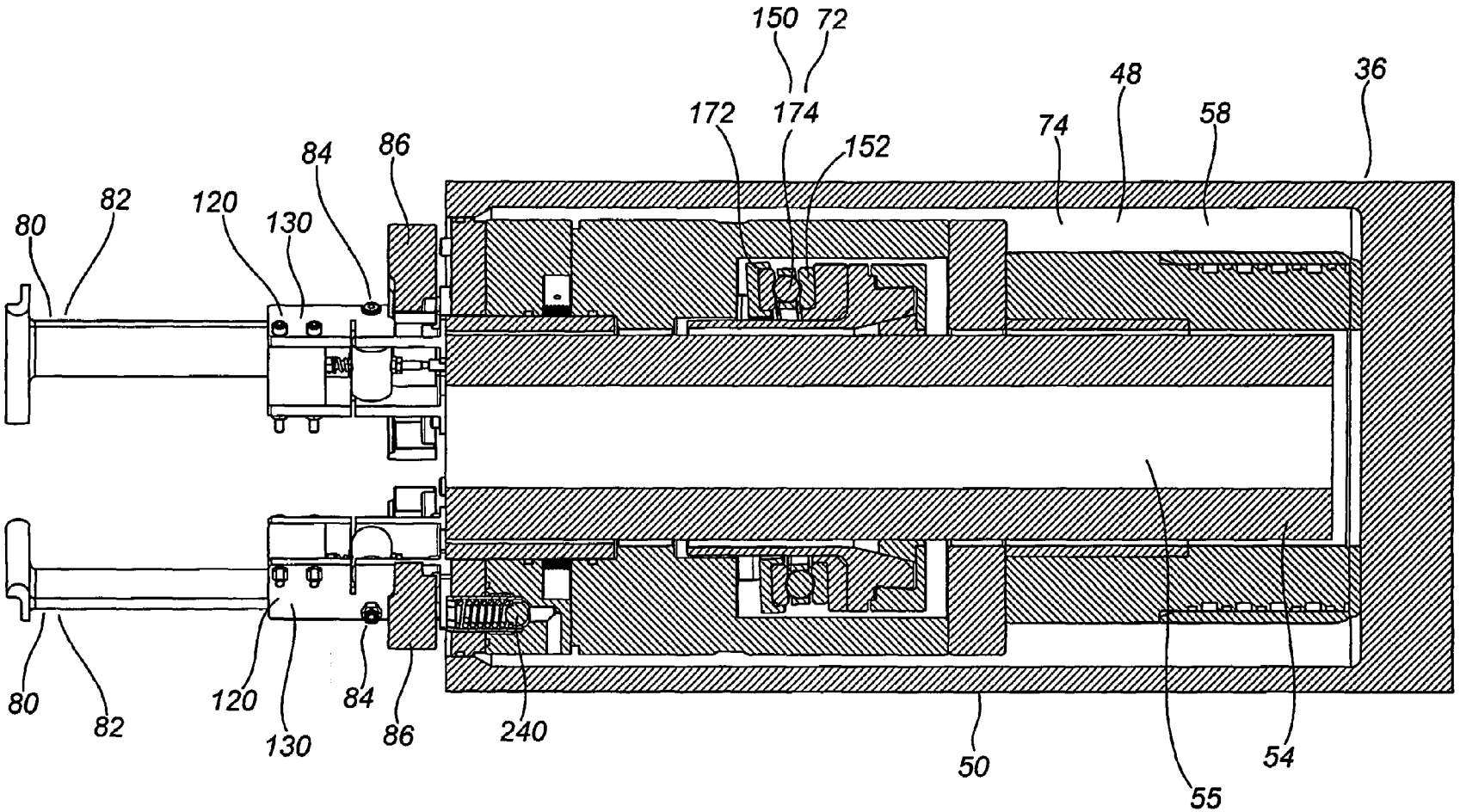
FIG. 9 is a longitudinal section assembly drawing of components of the hydraulic control system for the steering tool of FIG. 2, taken along section line IX-IX of FIG. 5.
Figure 10:
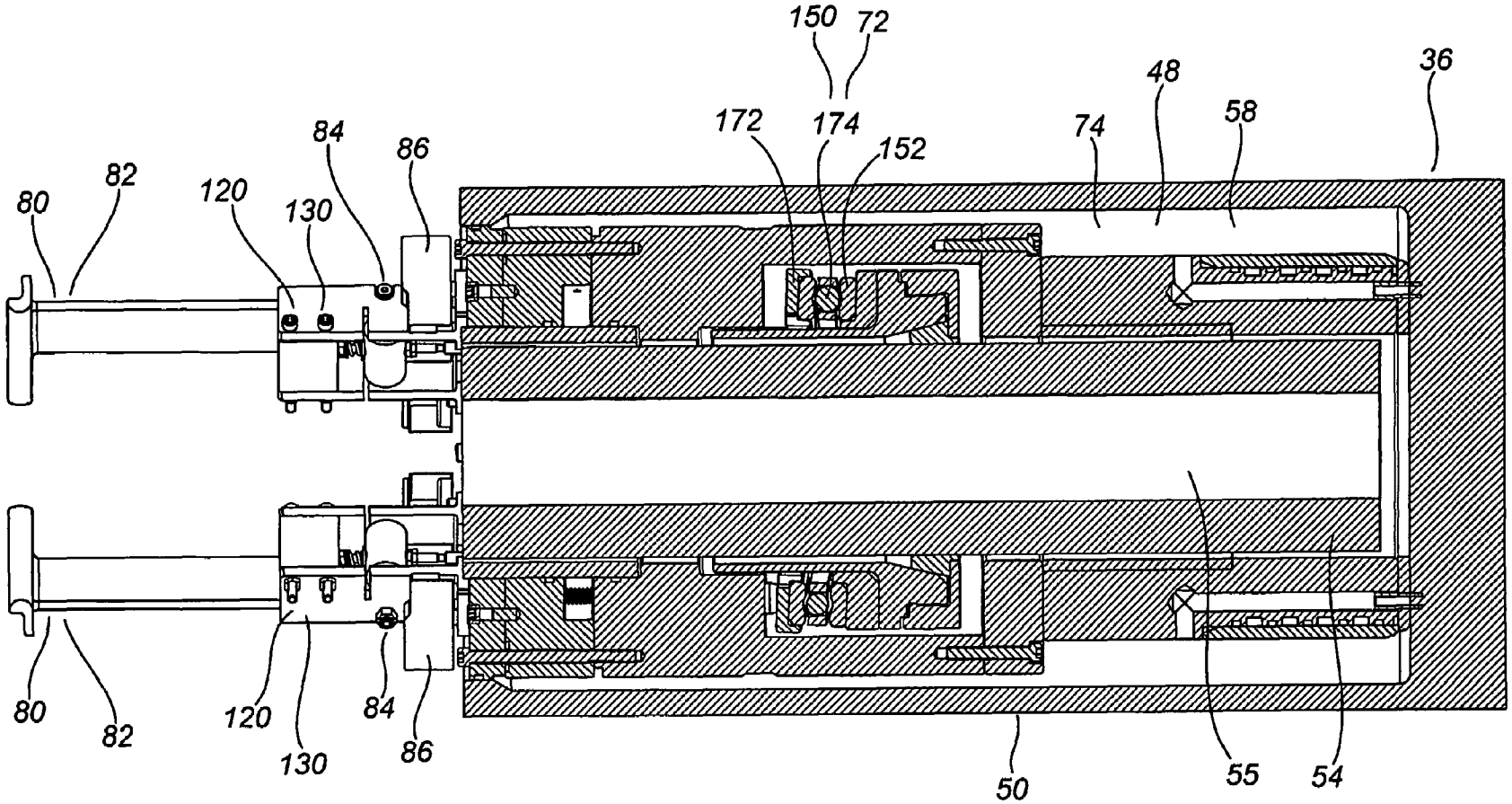
FIG. 10 is a longitudinal section assembly drawing of components of the hydraulic control system for the steering tool of FIG. 2, taken along section line X-X of FIG. 5.
Figure 11:
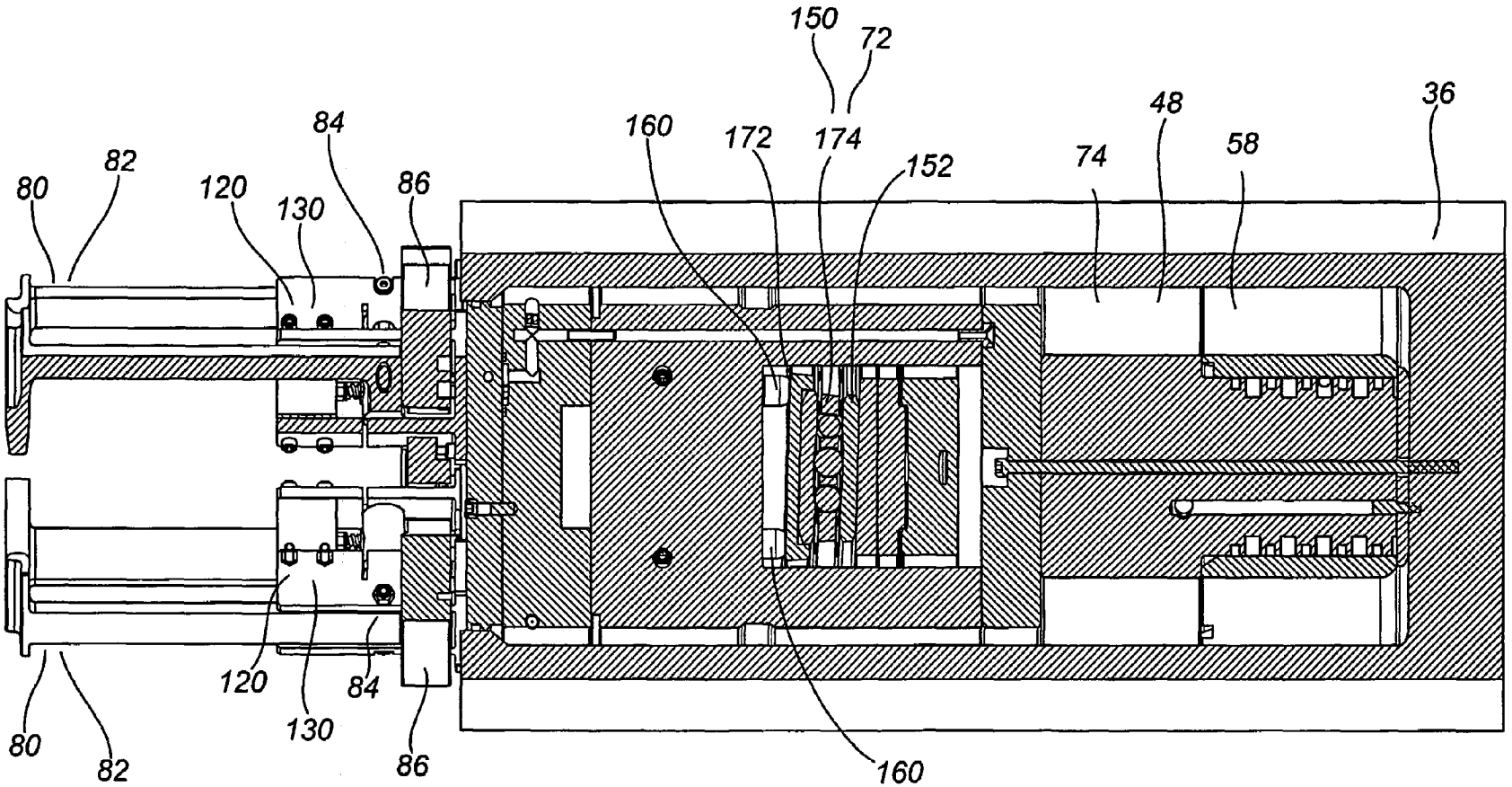
FIG. 11 is a longitudinal section assembly drawing of components of the hydraulic control system for the steering tool of FIG. 2, taken along section line XI-XI of FIG. 5.
Figure 12:
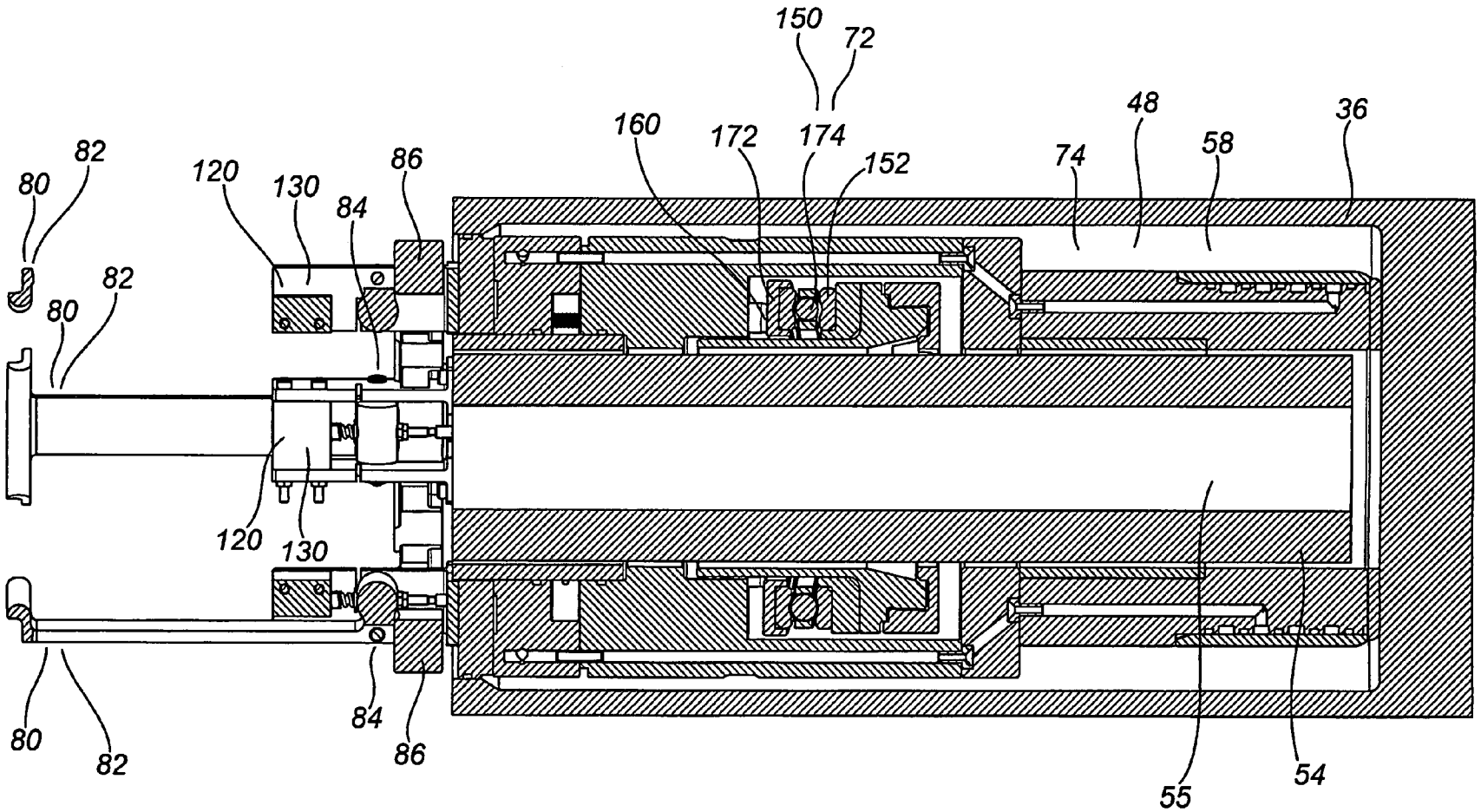
FIG. 12 is a longitudinal section assembly drawing of components of the hydraulic control system for the steering tool of FIG. 2, taken along section line XII-XII of FIG. 5.

Referring to FIG. 7 and FIG. 8, the hydraulic control system (42) is further comprised of a first pressure relief valve (180) which is set using a first biasing spring (182) at a first threshold pressure and a second pressure relief valve (184) which is set using a second biasing spring (186) at a second threshold pressure. The pressure relief valves (180,182) are located between the swash plate pump (150) and the valves (78) and communicate with the reservoir (74) when their threshold pressures are exceeded due to excessive resistance or blockage between the swash plate pump (150) and the steering devices (40). In the preferred embodiment the pressure relief valves (180,184) are set at a pressure of about 850 psi (or about 5860 kPa) and about 1250 psi (or about 8620 kPa).

Referring to FIG. 4, in the preferred embodiment each of the steering devices (40) is comprised of four steering pistons (190) which hydraulically communicate with each other so that the steering pistons (190) are simultaneously actuatable in order to actuate the steering device (40) between the retracted position and the extended position.

Referring to FIGS. 3-4 and FIGS. 6-12, in the preferred embodiment the steering pistons (190) are hydraulically connected with the valve (78) via a conduit comprising grooves or channels formed in the housing (36).

Referring to FIG. 4, each of the steering pistons (190) is contained in a steering piston cylinder (192) so that the steering pistons are hydraulically connected with the valve (78) via the steering piston cylinders (192). Since the hydraulic control system (42) in the preferred embodiment is comprised of a single-acting hydraulic system, only one side of the steering pistons (190) is hydraulically connected with the valve (78).

Consequently, movement of one of the mechanical valve actuators (80) from the first actuator position to the second actuator position results in its associated steering pistons (190) communicating with the pressurized hydraulic fluid via the steering piston cylinders (192), which in turn results in the steering pistons (190) extending outward from the housing (36) as the steering piston cylinders (192) fill with the pressurized hydraulic fluid from the swash plate pump (150). Conversely, movement of the mechanical valve actuator (80) from the second actuator position to the first actuator position results in the steering pistons (190) communicating with the reservoir (74), which in turn results in the steering pistons (190) retracting inward toward the housing (36) as the pressurized hydraulic fluid drains from the steering piston cylinders (192) back to the reservoir (74).

In the preferred embodiment, and referring to FIG. 4, each of the steering devices (40) is comprised of a steering device biasing mechanism (194) which biases the steering devices (40) toward the retracted position. Each steering device biasing mechanism (194) is comprised of steering device biasing springs (196) which are contained in the steering piston cylinders (192) and which engage the steering pistons (190) to urge them inward.

Referring to FIG. 14, in the alternate embodiment in which the hydraulic control system (42) is a double-acting hydraulic system, both sides of the steering pistons (190) are hydraulically connected with the valve (78) via separate conduits comprising grooves or channels in the housing (36).

Consequently, movement of one of the mechanical valve actuators (80) from the first actuator position to the second actuator position results in the steering pistons (190) extending outward from the housing (36) as the steering piston cylinders (192) on a first side of the steering pistons (190) fill with the pressurized hydraulic fluid from the swash plate pump (150) and the steering piston cylinders (192) on a second side of the steering pistons (190) drain the pressurized hydraulic fluid back to the reservoir (74). Conversely, movement of the mechanical valve actuator (80) from the second actuator position to the first actuator position reverses the process so that the steering piston cylinders (192) on the first side of the steering pistons (190) drain the pressurized hydraulic fluid back to the reservoir (74) while the steering piston cylinders (192) on the second side of the steering pistons (190) fill with pressurized hydraulic fluid from the swash plate pump (150).

Figure 17:
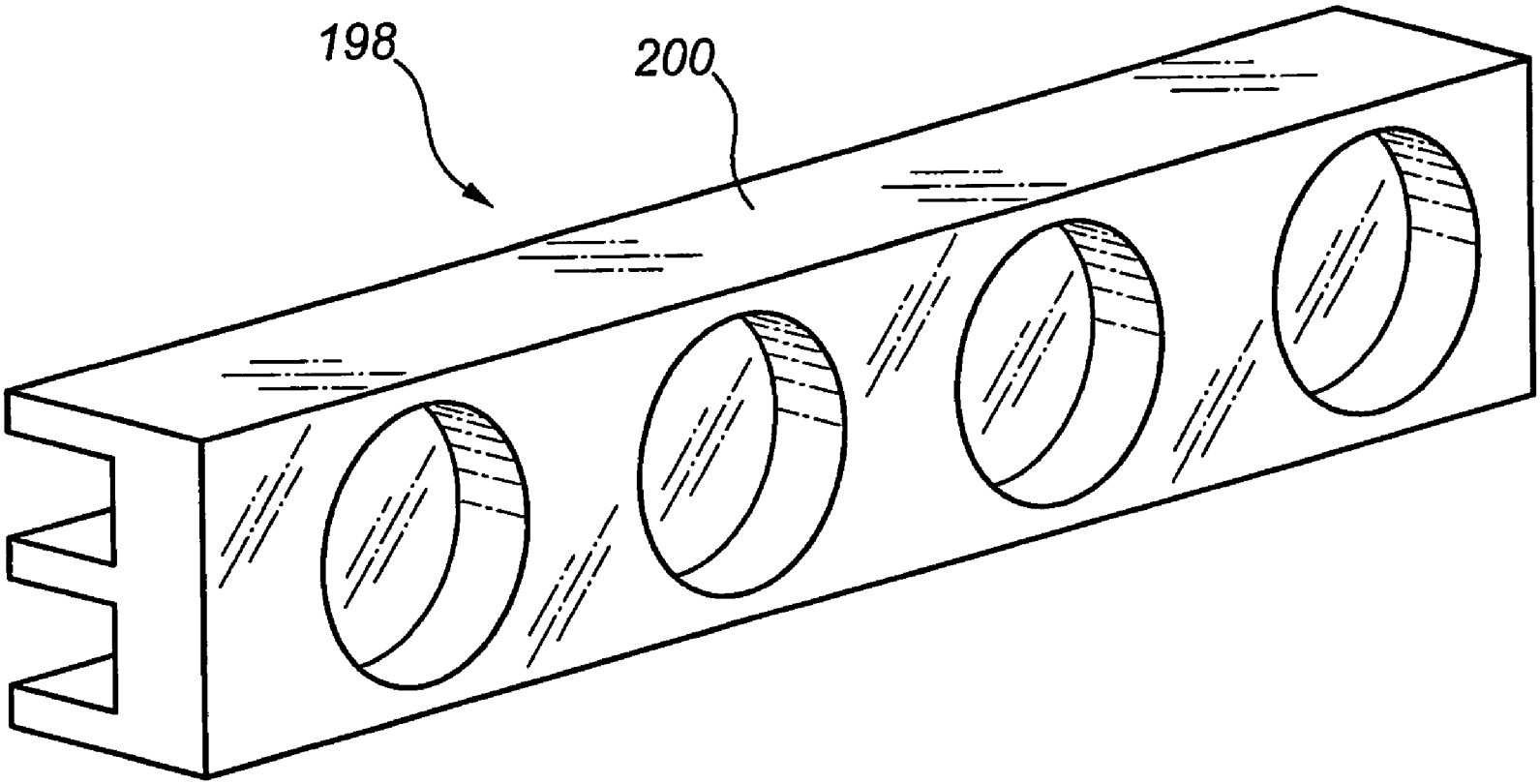
FIG. 17 is a pictorial bottom view of the aluminum core of one of the steering blades for the steering tool of FIG. 2.
Figure 18:
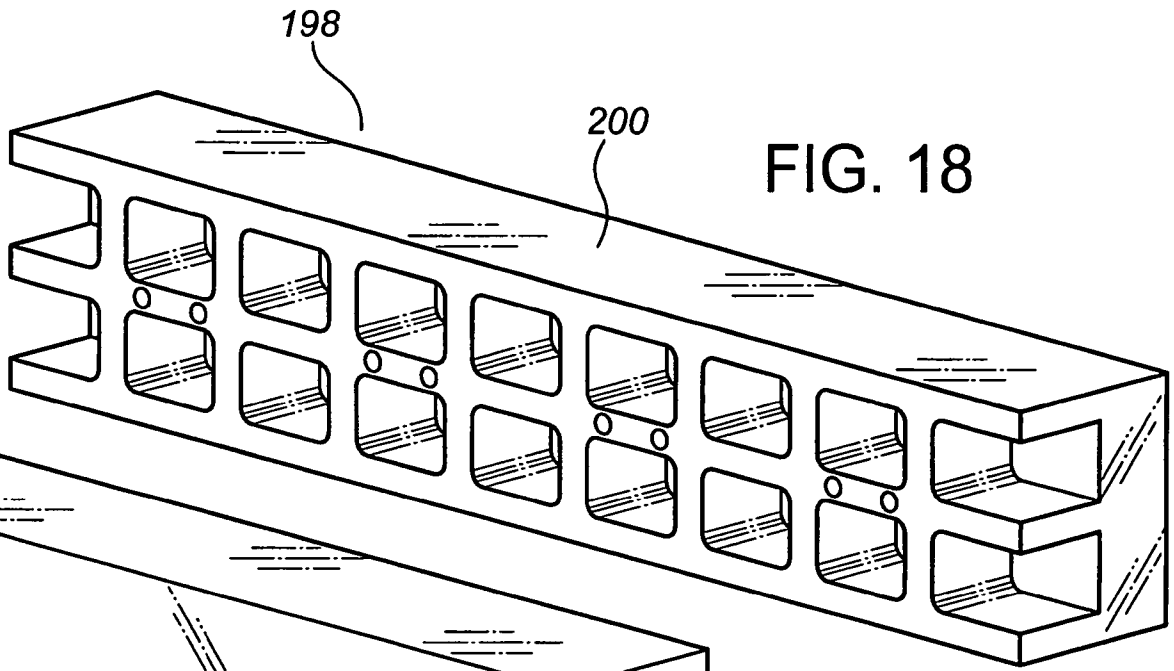
FIG. 18 is a pictorial top view of the aluminum core of one of the steering blades for the steering tool of FIG. 2.
Figure 19:
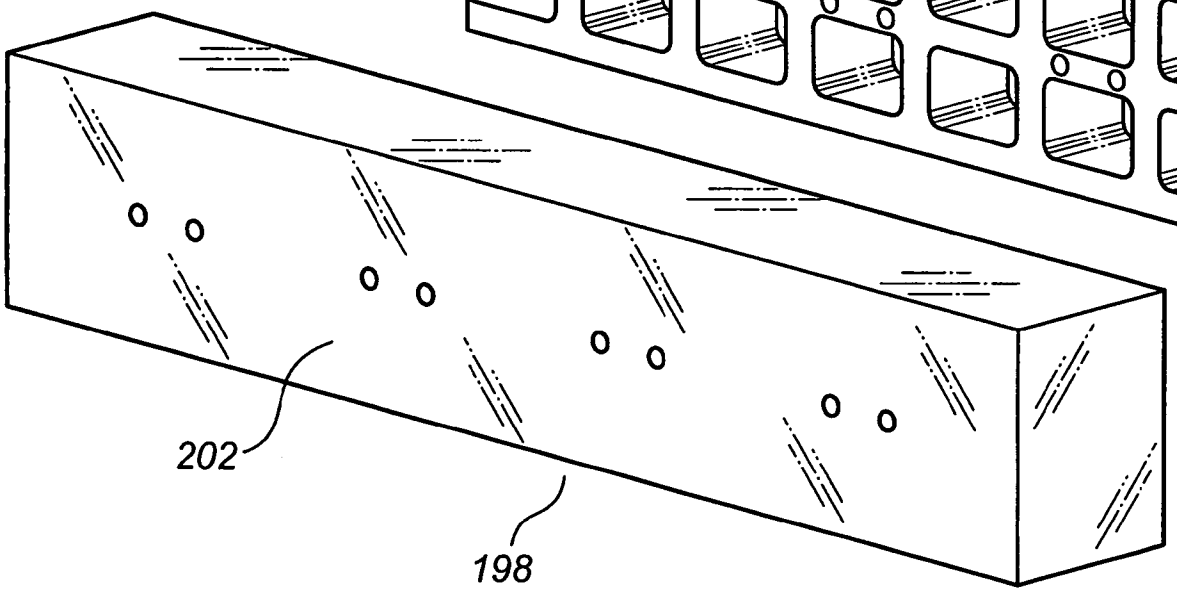
FIG. 19 is a pictorial top view of one of the steering blade covers for the steering tool of FIG. 2.

In the preferred embodiment each of the steering devices (40) is further comprised of a steering blade (198). Referring to FIGS. 17-19, each of the steering blades (198) is comprised of a steering blade core (200) having a honeycomb structure and constructed of aluminum and each of the steering blades (198) is further comprised of a steering blade cover (202) constructed of hard-faced steel. The steering blade cover (202) fits over the steering blade core (200) in order to protect the steering blade core (200).

The steering blade core (200) and the steering blade cover (202) are both connected with each of the steering pistons (190) by bolts which are accessible from the exterior (50) of the housing (36) without disassembling the steering tool (20).

The steering blades (198) are retained in a steering blade cavity (204) which is formed in the exterior (50) of the housing (36) by two blade stop members (206) which are located at both ends of the steering blade (198). Each of the blade stop members (206) is connected with the housing by a bolt which is accessible from the exterior (50) of the housing (36) without disassembling the steering tool (20).

Referring to FIGS. 3-4, the hydraulic control system (42) is further comprised of a hydraulic fluid pressure balancing mechanism (220) for transmitting a first ambient pressure to the hydraulic fluid at a first pressure balancing position (222) on the exterior (50) of the housing (36). The hydraulic fluid pressure balancing mechanism (220) is comprised of a hydraulic fluid balancing piston (224) contained in a hydraulic fluid balancing cylinder (226). A hydraulic fluid balancing port (228) is located in the exterior (50) of the housing (36) at the first pressure balancing position (222).

Also referring to FIG. 3, the steering tool (20) is also further comprised of a viscous medium pressure balancing mechanism (230) for transmitting a second ambient pressure to the viscous medium contained in the pendulum chamber (62) at a second pressure balancing position (232) on the exterior (50) of the housing (36). The viscous medium pressure balancing mechanism (230) is comprised of a viscous medium balancing piston (234) contained in a viscous medium balancing cylinder (236). A viscous medium balancing port (238) is located in the exterior (50) of the housing (36) at the first pressure balancing position (232).

In the preferred embodiment, the first pressure balancing position (222) and thus the hydraulic fluid balancing port (228) are located between the steering devices (40) and the lower end (46) of the housing (36). The second pressure balancing position (232) and thus the viscous medium balancing port (238) are located between the upper end (44) of the housing (36) and the steering devices (40).

The first ambient pressure at the first pressure balancing position (222) is likely to be greater than the second ambient pressure at the second pressure balancing position (232) during the operation of the steering tool (20). In addition, in the event that the steering devices (40) effectively "pack-off" a borehole during use of the steering tool, a large pressure spike may occur at the first pressure balancing position (222).

In the preferred embodiment, the hydraulic control system (42) is therefore further comprised of an emergency relief valve (240) which is connected between the hydraulic control system (42) and the pendulum chamber (62) such that the hydraulic control system (42) communicates with the pendulum chamber (62) when the emergency relief valve (240) is in an open position., thereby releasing an amount of the hydraulic fluid from the hydraulic control system (42) to the pendulum chamber (62). In the preferred embodiment the emergency relief valve (240) is set to about 2000 psi or about 13800 kPa.

Referring to FIG. 3, in the preferred embodiment, the steering tool (20) is further comprised of a stabilizer (250) on the exterior (50) of the housing (36). In the preferred embodiment, the stabilizer (250) is located between the upper end (44) of the housing (36) and the steering devices (40).

The stabilizer (250) is comprised of a plurality of stabilizer blades (252) circumferentially spaced about the exterior (50) of the housing (36). The stabilizer blades (252) are removable from the housing (36) without disassembling the steering tool (20).

Each of the stabilizer blades (252) is retained in a stabilizer blade cavity (254) in the exterior (50) of the housing (36) by a stabilizer retaining ring (256) which is positioned at one end of the stabilizer blade (252). Each of the stabilizer blades (252) is further retained in the stabilizer blade cavity (254) by a combination, at the other end of the stabilizer blade (252), of an undercut (258) formed in the stabilizer blade (252) and an overcut (260) formed in the stabilizer blade cavity (254).

The stabilizer blades (252) are installed in the steering tool (20) by first inserting each of the stabilizer blades (252) in their respective stabilizer blade cavities (254) so that the undercuts (258) engage the overcuts (260), and then the stabilizer retaining ring is tightened over all of the stabilizer blades (252) to hold the stabilizer blades (252) in the stabilizer blade cavity (254).

Referring to FIG. 3, the steering tool (20) is further comprised of a thrust bearing assembly (270) for transmitting axial loads from the drill bit (24) and the shaft (54) to the housing (36) so that the axial loads do not pass through the rotor (not shown) of the drilling motor (26). In embodiments of the steering tool (20) in which the steering tool (20) is adapted to be connected with the drilling motor (26) as a separate tool or component, the thrust bearing assembly (270) may be provided by the drilling motor (26). The thrust bearing assembly (270) is lubricated by drilling fluid which passes through the housing bore (52) between the housing (36) and the shaft (54).

Referring to FIG. 3, the steering tool (20) is also further comprised of an upper radial bearing (272), an intermediate radial bearing (274) and a lower radial bearing (276) for radially supporting the shaft (54) within the housing (36). In the preferred embodiment, the radial bearings (272,274,276) are relatively close fit bearings which allow very little radial movement of the shaft (54) relative to the housing (36), thus maximizing the effectiveness of the steering devices (40) in pushing the housing (36) back toward the target orientation when the steering devices are actuated to the extended position. The radial bearings (272,274,276) are lubricated by drilling fluid which passes through the housing bore (52).

In order to provide adequate flow of drilling fluid past the radial bearings (272,274,276), the radial bearings are comprised of helical flutes (not shown) which provide helical channels for drilling fluid to pass through, while still providing for close contact between the bearings (272,274,276) and the shaft (54). The helical design of the flutes ensures contact between the bearings (272,274,276) and the shaft (54) regardless of the relative positions of the shaft (54) and the bearings (272,274,276), since the flutes are sequentially and continuously moving into and out of contact with the shaft (54).

In the preferred embodiment, the mating surfaces of the radial bearings (272,274,276) are comprised of press fit carbide sleeves which provide a long wear life and which are also easily replaceable. In the preferred embodiment, the helical flutes are configured as left hand helixes in order to prevent contaminates contained in the drilling fluid from threading into the flutes during rotation of the shaft (54) and thereby causing torque or damage to the steering tool (20) or seizure of the shaft (54).

In use of the preferred embodiment, the steering tool (20) is incorporated into the drill string (22) so that the steering tool (20) is between the power section (not shown) of the drilling motor (26) and the drill bit (24).

In the preferred embodiment, the drill string (22), including the steering tool (20) and the drilling motor (26), are not typically rotated during drilling. Instead, the drill bit (24) is rotated by the drilling motor (26).

The axis of the pendulum (60) will remain substantially parallel with the axis of the housing (36) as long as the housing (36) remains in a vertical orientation as the target orientation. As a result, the four actuating levers (82) remain in the first actuator position and the steering devices (40) remain in the retracted position.

Minor pivoting movement of the pendulum (60) due to vibration or transient deviations of the housing (36) is dampened by the viscous medium contained in the pendulum chamber (62) and by the mechanical actuator dampening mechanism (130).

If the housing (36) begins to deviate from the vertical orientation, the pendulum (60) will pivot in the pendulum chamber (62), thus providing an actuating movement in the direction of the pivoting movement. The actuating movement is accompanied by an actuating force due to the weight of the pendulum (60).

The distal end (70) of the pendulum (60) will engage one or two of the four actuating levers (82) and the actuating movement will move the engaged actuating levers (82) from the first actuator position toward the second actuator position once the actuating force is sufficient to overcome any resistance to movement of the engaged actuating levers (82) due to friction and/or due to the valve mechanism biasing device (120).

Movement of the engaged actuating levers (82) toward the second actuator position will cause operation of the valves (78) which are associated with the engaged actuating levers (82).

In the preferred embodiment as depicted in FIG. 3 and FIG. 6 where the valves (78) are shuttle valves, the valve bodies (98) will remain seated in the pressurized hydraulic fluid ports (100) as long as the engaged actuating levers (82) remain in the first actuator position, with the result that the steering devices (40) associated with the engaged actuating levers (82) are in communication only with the reservoir (74). Slight movement of the engaged actuating levers (82) toward the second actuator position will unseat the valve bodies (98) from the pressurized hydraulic fluid ports (100), thereby establishing some communication between the pressurized hydraulic fluid provided by the swash plate pump (150) and the steering devices (40), while maintaining some communication between the reservoir (74) and the steering devices (40). Pivoting movement of the pendulum (60) which reflects a deviation of the housing (36) from the vertical orientation of about 0.183 degrees or more will provide an actuating movement which is sufficient to move the engaged actuating levers (82) to the second actuator position. At the second actuator position, the valve bodies (98) of the shuttle valve will seat in the reservoir ports (102) of the valves (78), thereby eliminating communication between the reservoir (74) and the steering devices (40) while establishing full communication between the pressurized hydraulic fluid provided by the swash plate pump (150) and the steering devices (40).

The steering devices (40) will be actuated to the extended position due to the communication between the pressurized hydraulic fluid provided by the swash plate pump (150) and the steering devices (40). In the preferred embodiment where the valves (74) are shuttle valves, the steering devices (40) will become actuated to the extended position as the actuating levers (82) are moved closer to the second actuator position, as the communication between the pressurized hydraulic fluid and the steering devices (40) becomes proportionately greater and the communication between the reservoir (74) and the steering devices (40) becomes proportionately less, due to movement of the valve bodies (98) between the pressurized hydraulic fluid port (100) and the reservoir port (102).

When the engaged actuating levers (82) are relatively close to the first actuator position, the steering devices (40) may remain actuated at the retracted position. When the engaged actuating levers (82) are relatively close to the second actuator position, the steering devices (40) may become actuated tot the extended position relatively quickly. The actuation of the steering devices (40) to the extended position will be opposed by the biasing forces provided by the steering device biasing mechanisms (194) and by any external forces which may be exerted on the steering devices (40) by the borehole or some other source.

The swash plate pump (150) operates continuously as long as the shaft (54) is rotating due to operation of the drilling motor (26). As a result, where the pumping rate of the swash plate pump (150) exceeds the extent to which the pressurized hydraulic fluid may be communicated to the steering devices (40), the pressurized hydraulic fluid is returned to the reservoir (74) via one or both of the pressure relief valves (180, 184).

The engaged actuating levers (82) and their associated steering devices (40) are offset by substantially 180 degrees. As a result, pivoting of the pendulum (60) toward the "low side" of the steering tool (20) will result in the steering devices (40) at the "high side" of the steering tool to become actuated to the extended position in order to push the housing (36) back toward the vertical orientation.

As the housing (36) moves back toward the vertical orientation, the pendulum (60) pivots back toward the position where the axis of the pendulum (60) is substantially parallel to the axis of the housing (36). An actuating movement of the pendulum (60) is therefore generated which allows the engaged actuating levers (82) to move back toward the first actuator position.

As the engaged actuating levers (82) move back toward the first actuator position, the communication between the pressurized hydraulic fluid and the steering devices (40) lessens and communication between the reservoir (74) and the steering devices (40) is established and/or is increased. As the engaged actuating levers (82) move closer to the first actuator position, the steering devices (40) will become actuated to the retracted position, assisted by the biasing force of the steering device biasing mechanism (194) and by any external forces exerted on the steering devices (40).

As a result, it may be seen that the steering tool (20) in the preferred embodiment is configured so that inadvertent actuation of the steering devices (40) to the extended position is minimized, due to the dampening effect of the viscous medium in the pendulum chamber (62), the dampening effect of the mechanical actuator dampening mechanism (130), the biasing effects of the steering device biasing mechanisms (194), and the configuration of the actuating levers (82) and the valves (74), which configuration effectively limits actuation of the steering devices (40) to the extended position unless the actuating levers (82) are moved significantly toward the second actuator position.

In the event that the drill string (22) is rotated in order to perform rotary drilling with the drill string (22), the steering devices (40) will be inhibited from actuating or moving to the extended position due to their reduced weight (which limits centrifugal forces), due to the biasing effects of the steering device biasing mechanisms (194), and due to the relative light weight and substantial balancing of the actuating levers (82).

In addition, in the preferred embodiment the actuating levers (82) each extend circumferentially about the interior of the housing (36) for about sixty degrees, with the result that a space of about thirty degrees separates the peripheral edges of the actuating levers (82). As a result, during rotation of the drill string (22) during rotary drilling, the actuating levers (82) are in the second actuator position for less than half of each rotation of the drill string (22), regardless of the orientation of the housing (36). The steering devices (40) therefore have more opportunity to move to the retracted position than to the extended position during rotation of the drill string (22).

Referring to FIG. 1(*b*), in a second configuration the steering tool (20) is adapted as a component of a rotary steerable drilling system (32). In this second configuration, the housing (36) may be connected with a drill string (22) with suitable bearings (not shown) so that the drill string (22) provides the shaft (54). The pressurization device (72) may be comprised of the swash plate pump (150), which may be associated with both the drill string (22) and the housing (36) in a similar manner as in the preferred embodiment. Alternatively, the pressurization device (72) may be comprised of a different type of pump or may be comprised of a system for using the pressure of drilling fluid in order to actuate the steering devices (40).

In the second configuration, a borehole engaging device (34) may be associated with the housing (36) in order to inhibit the housing (36) from rotating with the drill string (22) as the drill string (22) during drilling. In the second configuration, drilling fluid may be passed through the drill string (22) in order to circulate the drilling fluid through the steering tool (20), and a small amount of drilling fluid may be permitted to pass between the drill string (22) and the housing (36) in order to lubricate components of the steering tool (20).

The second configuration of the steering tool (20) may otherwise be configured and operated in a similar manner as the steering tool (20) described in the preferred embodiment.

Referring to FIG. 1(*c*), in a third configuration the steering tool (20) is adapted as a component of a fully rotating rotary steerable drilling system (32) of the type in which a steering mechanism is connected with the drill string (22) so that the steering mechanism rotates with the drill string (22) during rotary drilling.

In this third configuration, the tool actuating device (38), the steering devices (40) and the hydraulic control system (42) are configured so that the steering devices (40) are capable of actuating between the retracted position and the extended position in synchronization with the rotation of the drill string (22) so that the steering devices (40) are actuated substantially at the same rotational position during rotation of the drill string (22) in order to move the housing (36) back toward the target orientation.

In this third configuration, a shaft (54) may or may not be provided for the steering tool (20). A shaft (54) may be provided by a drilling motor (not shown) which is incorporated into the drill string (22) or by a member (not shown) which is contained within the housing bore (52). The purpose of the shaft (54) may be to provide a rotary movement to power a pump in similar manner as described in the preferred embodiment. Alternatively, the pressurization device (72) may be comprised of a different type of pump or may be comprised of a system for using the pressure of drilling fluid in order to actuate the steering devices (40).

Drilling fluid may be passed through the housing bore (52) in order to circulate the drilling fluid through the steering tool (20). Alternatively or additionally, if a shaft (54) is provided in the steering tool (20), the drilling fluid may be passed through the shaft bore (55).

In the third configuration, it may be necessary to provide modifications to the preferred embodiment of the steering tool (20) so that the steering devices (40) are capable of being actuated quickly enough to provide synchronization with the rotation of the drill string (22). As a first example, the dampening effects of the viscous medium in the pendulum chamber (62) and the mechanical actuator dampening mechanism (130) may be reduced. As a second example, the flowrates of hydraulic fluid to and from the steering devices (40) may be increased by increasing the size of the conduits amongst the pressurization device (72), the reservoir (74), and the steering devices (40). As a third example, the pumping rate of the pressurization device (72) may be increased. As a fourth example, a double-acting hydraulic system may be utilized. As a fifth example, a tool actuating device (38) which has a shorter natural frequency than the pendulum (60) of the preferred embodiment may be used.

Finally, in any of the configurations of the steering tool (20), the steering tool (20) may provide a vertical orientation as the target orientation or may provide some other orientation as the target orientation. If the target orientation is not a vertical orientation, the orientation of the tool actuating device (38) in the housing (36) may be altered to reflect the target orientation. Alternatively or additionally, the mechanical valve actuators (80) may be configured so that the first actuator position and the second actuator position are provided with reference to the target orientation.

If the target orientation is not a vertical orientation, the steering tool (20) or the drill string (22) may be further comprised of a surveying system (not shown) for determining the orientation of the steering tool (20) relative to a reference orientation so that the target orientation of the steering tool (20) has a reference.

Furthermore, in any of the configurations of the steering tool (20), the drill string (22) may be further comprised of any suitable drilling equipment and drilling tools for use in association with the drill string (22) and/or in association with any components of the drill string (22), including the steering tool (20).

The embodiments of the invention in which an exclusive property or privilege is claimed are defined as follows:

1. A steering tool for use in drilling a borehole, comprising:

(a) a tubular housing, the housing having an interior, an exterior, and defining a housing bore;

(b) a tool actuating device movably supported within the interior of the housing, the tool actuating device being capable of an actuating movement relative to the housing;

(c) a plurality of hydraulically actuated steering devices circumferentially spaced about the exterior of the housing, the steering devices being independently actuatable between a retracted position and an extended position as a result of the actuating movement of the tool actuating device;

(d) a hydraulic control system contained within the interior of the housing and operably interposed between the tool actuating device and the steering devices, for converting the actuating movement of the tool actuating device to independent actuation of the steering devices between the retracted position and the extended position; and (e) a hydraulic fluid for use in the hydraulic control system in order to actuate the steering devices, wherein the hydraulic fluid is isolated from other fluids.

2. The steering tool as claimed in claim 1 wherein the hydraulic fluid is comprised of a hydraulic oil.

3. The steering tool as claimed in claim 1 wherein the hydraulic control system is comprised of a pressurization device for pressurizing the hydraulic fluid to provide a supply of pressurized hydraulic fluid.

4. The steering tool as claimed in claim 3 wherein the steering tool is configured so that each of the steering devices is actuated to the retracted position when the housing is at a target orientation.

5. The steering tool as claimed in claim 3 wherein the steering tool is adapted to be configured as a component of a drilling motor having a motor housing and a motor drive shaft such that the housing of the steering tool is connected with the motor housing and such that the motor drive shaft extends through the housing bore.

6. The steering tool as claimed in claim 3, further comprising a shaft extending through the housing bore, the shaft being capable of a drilling movement relative to the housing.

7. The steering tool as claimed in claim 6 wherein the shaft defines a shaft bore for conducting a drilling fluid through the steering tool.

8. The steering tool as claimed in claim 7 wherein the pressurization device is comprised of a pump and wherein the pump is associated with both the housing and the shaft.

9. The steering tool as claimed in claim 8 wherein the drilling movement of the shaft is a rotary movement and wherein the pump is comprised of a swash plate pump.

10. The steering tool as claimed in claim 4 wherein the hydraulic control system is further comprised of a plurality of valve mechanisms, wherein each of the valve mechanisms is associated with the tool actuating device and with one of the steering devices, and wherein each of the valve mechanisms is capable of selectively providing communication of its associated steering device with the pressurized hydraulic fluid as a result of the actuating movement of the tool actuating device.

11. The steering tool as claimed in claim 10 wherein each of the valve mechanisms is comprised of a mechanical valve actuator for the valve mechanism, wherein the mechanical valve actuators are located in the interior of the housing, wherein the mechanical valve actuators are circumferentially spaced about the interior of the housing, and wherein the mechanical valve actuators are located adjacent to the tool actuating device so that they may be moved by the actuating movement of the tool actuating device.

12. The steering tool as claimed in claim 11 wherein the mechanical valve actuators are capable of movement by the tool actuating device between a first actuator position and a second actuator position and wherein the steering tool is configured so that each of the steering devices is actuated to the retracted position when its associated mechanical valve actuator is in the first actuator position and so that each of the steering devices is actuated to the extended position when its associated mechanical valve actuator is in the second actuator position.

13. The steering tool as claimed in claim 12 wherein the actuating movement of the tool actuating device is caused by a force selected from the group of forces consisting of a gravitational force, an inertial force and a magnetic force.

14. The steering tool as claimed in claim 12 wherein the hydraulic control system is further comprised of a reservoir for the hydraulic fluid and wherein the reservoir has a reservoir pressure which is lower than a pressure of the pressurized hydraulic fluid.

15. The steering tool as claimed in claim 14 wherein each of the steering devices is in communication only with the reservoir when its associated mechanical valve actuator is in the first actuator position and wherein each of the steering devices is in communication only with the pressurized hydraulic fluid when its associated mechanical valve actuator is in the second actuator position.

16. The steering tool as claimed in claim 14 wherein the pressurization device draws the hydraulic fluid from the reservoir in order to provide the supply of the pressurized hydraulic fluid.

17. The steering tool as claimed in claim 14 wherein the steering tool is configured so that each of the mechanical valve actuators is at the first actuator position when the housing is at the target orientation.

18. The steering tool as claimed in claim 17 wherein each of the valve mechanisms is further comprised of a valve mechanism biasing device for biasing the mechanical valve actuator toward the first actuator position.

19. The steering tool as claimed in claim 12 wherein each of the valve mechanisms is further comprised of a mechanical actuator dampening mechanism for dampening the movement of the mechanical valve actuator.

20. The steering tool as claimed in claim 19 wherein the mechanical actuator dampening mechanism is comprised of a fluid metering device operably connected with the mechanical valve actuator.

21. The steering tool as claimed in claim 20 wherein the fluid metering device is comprised of:

(a) a dampening cylinder;

(b) a metering piston reciprocably contained within the dampening cylinder so that the dampening cylinder is divided into a first chamber and a second chamber; and (c) a restricted flowpath between the first chamber and the second chamber for permitting a restricted flow of a fluid between the first chamber and the second chamber as the metering piston reciprocates relative to the dampening cylinder as a result of movement of the mechanical valve actuator.

22. The steering tool as claimed in claim 12 wherein each of the mechanical valve actuators is comprised of an actuating lever.

23. The steering tool as claimed in claim 22 wherein each of the actuating levers is comprised of a pivot point and wherein each of the actuating levers is substantially balanced about the pivot point.

24. The steering tool as claimed in claim 12 wherein each of the steering devices and their associated mechanical valve actuators are circumferentially offset from each other by substantially 180 degrees.

25. The steering tool as claimed in claim 3 wherein the tool actuating device is comprised of a pendulum pivotably supported within the interior of the housing and wherein the actuating movement is a pivoting movement relative to the housing in order to maintain a vertical orientation of the pendulum.

26. The steering tool as claimed in claim 25 wherein the pendulum is comprised of a tubular member which is located within the interior of the housing such that the pendulum surrounds the housing bore.

27. The steering tool as claimed in claim 26 wherein the pendulum is pivotably supported within the housing by a universal joint.

28. The steering tool as claimed in claim 27 wherein the pendulum is contained in a viscous medium so that the pivoting movement of the pendulum is subject to viscous damping.

29. The steering tool as claimed in claim 28, further comprising a pendulum chamber for containing the pendulum and the viscous medium.

30. The steering tool as claimed in claim 29 wherein the viscous medium is comprised of a hydraulic oil.

31. The steering tool as claimed in claim 29 wherein the pendulum chamber is isolated from the hydraulic control system so that the viscous medium is isolated from the hydraulic fluid.

32. The steering tool as claimed in claim 31 wherein the hydraulic control system is further comprised of a hydraulic fluid pressure balancing mechanism for transmitting to the hydraulic fluid a first ambient pressure at a first pressure balancing position on the exterior of the housing.

33. The steering tool as claimed in claim 32, further comprising a viscous medium pressure balancing mechanism for transmitting to the viscous medium a second ambient pressure at a second pressure balancing position on the exterior of the housing.

34. The steering tool as claimed in claim 33 wherein the housing has an upper end and a lower end, wherein the steering devices are located between the upper end and the lower end, and wherein the second pressure balancing position is between the upper end of the housing and the steering devices.

35. The steering tool as claimed in claim 34 wherein the first pressure balancing position is between the steering devices and the lower end of the steering tool.

36. The steering tool as claimed in claim 35 wherein the hydraulic control system is further comprised of an emergency relief valve and wherein the hydraulic control system communicates with the pendulum chamber when the emergency relief valve is in an open position, thereby releasing the hydraulic fluid into the pendulum chamber.

37. The steering tool as claimed in claim 25 wherein the hydraulic control system is further comprised of a plurality of valve mechanisms, wherein each of the valve mechanisms is associated with the tool actuating device and with one of the steering devices, and wherein each of the valve mechanisms is capable of selectively providing communication of its associated steering device with the pressurized hydraulic fluid as a result of the actuating movement of the tool actuating device.

38. The steering tool as claimed in claim 37 wherein each of the valve mechanisms is comprised of a mechanical valve actuator for the valve mechanism, wherein the mechanical valve actuators are located in the interior of the housing, wherein the mechanical valve actuators are circumferentially spaced about the interior of the housing, and wherein the mechanical valve actuators are located adjacent to the tool actuating device so that they may be moved by the actuating movement of the tool actuating device.

39. The steering tool as claimed in claim 38 wherein the mechanical valve actuators are capable of movement by the tool actuating device between a first actuator position and a second actuator position and wherein the steering tool is configured so that each of the steering devices is actuated to the retracted position when its associated mechanical valve actuator is in the first actuator position and so that each of the steering devices is actuated to the extended position when its associated mechanical valve actuator is in the second actuator position.

40. The steering tool as claimed in claim 39 wherein the pendulum is comprised of a proximal end and a distal end, wherein the proximal end of the pendulum is pivotably supported within the housing, and wherein the mechanical valve actuators are located adjacent to the distal end of the pendulum.

41. The steering tool as claimed in claim 39 wherein each of the steering devices and their associated mechanical valve actuators are circumferentially offset from each other by substantially 180 degrees.

42. The steering tool as claimed in claim 40 wherein the pendulum has a center of gravity and wherein the center of gravity of the pendulum is located closer to the distal end of the pendulum than to the proximal end of the pendulum.

43. The steering tool as claimed in claim 42 wherein the pendulum is comprised of at least one weighting ring for adding weight to the pendulum and wherein the weighting ring is located closer to the distal end of the pendulum than to the proximal end of the pendulum.

44. The steering tool as claimed in claim 43 wherein the weighting ring is comprised of a carbide ring.

45. The steering tool as claimed in claim 40 wherein each of the mechanical valve actuators is comprised of an actuating lever.

46. The steering tool as claimed in claim 45 wherein each of the actuating levers is comprised of a pivot point and wherein each of the actuating levers is substantially balanced about the pivot point.

47. The steering tool as claimed in claim 45 wherein the housing has an upper end and a lower end, wherein the steering tool is further comprised of a stabilizer associated with the housing, and wherein the stabilizer is located between the upper end of the housing and the steering devices.

48. The steering tool as claimed in claim 3 wherein the steering tool is comprised of four steering devices which are circumferentially spaced from each other by ninety degrees.

49. The steering tool as claimed in claim 3 wherein each of the steering devices is comprised of at least one steering piston which is actuatable between the retracted position and the extended position.

50. The steering tool as claimed in claim 49 wherein each of the steering devices is comprised of a plurality of steering pistons which are simultaneously actuatable between the retracted position and the extended position.

51. The steering tool as claimed in claim 50 wherein each of the steering devices is further comprised of a steering blade connected with the steering pistons.

52. The steering tool as claimed in claim 51 wherein each of the steering devices is further comprised of a steering device biasing mechanism for biasing the steering device toward the retracted position.

53. The steering tool as claimed in claim 51 wherein the steering blades may be replaced without disassembling the steering tool.

54. The steering tool as claimed in claim 3 wherein the housing has an upper end and a lower end, wherein the steering tool is further comprised of a stabilizer associated with the housing, and wherein the stabilizer is located between the upper end of the housing and the steering devices.

55. The steering tool as claimed in claim 54 wherein the stabilizer is comprised of a plurality of stabilizer blades and wherein the stabilizer blades may be replaced without disassembling the steering tool.

56. The steering tool as claimed in claim 3 wherein the steering tool is adapted such that a drill string may extend through the housing bore and such that the housing of the steering tool may be rotatably connected with the drill string.

57. The steering tool as claimed in claim 56, further comprising a borehole engaging device associated with the housing for engaging a borehole in order to inhibit the steering tool from rotating in the borehole when the drill string is rotated.

58. The steering tool as claimed in claim 3 wherein the steering tool is adapted such that the housing of the steering tool may be fixedly connected with a drill string so that the housing of the steering tool rotates when the drill string is rotated.

59. The steering tool as claimed in claim 47 wherein the steering tool is adapted to be configured as a component of a drilling motor having a motor housing and a motor drive shaft such that the housing of the steering tool is connected with the motor housing and such that the motor drive shaft extends through the housing bore.

60. The steering tool as claimed in claim 59 wherein the steering tool is comprised of four steering devices which are circumferentially spaced from each other by ninety degrees.

61. The steering tool as claimed in claim 13 wherein the actuating movement of the tool actuating device is caused by a gravitational force in response to a change in an orientation of the housing relative to gravity.

* * * * *